United States Patent [19]

Howell

[11] 4,318,326

[45] Mar. 9, 1982

[54] PLURAL MANUAL ORGAN HAVING TRANSPOSER

[75] Inventor: Stephen L. Howell, Huntingburg, Ind.

[73] Assignee: Kimball International, Inc., Jasper, Ind.

[21] Appl. No.: 220,309

[22] Filed: Dec. 29, 1980

[51] Int. Cl.[3] ..... G10H 1/00; G10C 3/12

[52] U.S. Cl. ..... 84/1.01; 84/445; 84/1.03

[58] Field of Search ..... 84/1.01, 1.03, 445

[56] References Cited

U.S. PATENT DOCUMENTS

| | | | |
|---|---|---|---|
| 3,610,800 | 10/1971 | Deutsch | 84/1.01 |
| 4,011,784 | 3/1977 | Fukui | 84/1.01 |
| 4,072,078 | 2/1978 | Shallenberger et al. | 84/1.03 |
| 4,147,085 | 4/1979 | Robinson | 84/1.17 |
| 4,228,714 | 10/1980 | Howell | 84/1.01 |

*Primary Examiner*—J. V. Truhe
*Assistant Examiner*—Forester W. Isen
*Attorney, Agent, or Firm*—Albert L. Jeffers; John F. Hoffman

[57] ABSTRACT

An electronic organ, particularly of the institutional type employing classical voicing, having Swell and Great manuals as well as a full pedalboard wherein the manuals and pedalboard are multiplexed simultaneously to produce a plurality of synchronized serial data streams. Intermanual coupling is accomplished by connecting the data stream from one manual to the footage generation circuit of another manual, and footages are generated for each manual by utilizing tapped shift registers introducing controlled amounts of delay of the keyboard data before demultiplexing thereof. There is a bank of multiplexers for each voice, such as flutes, principals, complex and percussion, which receive the serial data streams from one or more of the footage generators. The demultiplexer-keyers are supplied with tones and function to demultiplex the serial data streams and provide tones selected in accordance with the keydown pulses in the serial data streams to the voicing circuitry. Because the footages are generated by selectively delaying the data streams, each manual is scanned twice and the data is gated off on alternate scans to permit the data streams to be supplemented with the lower frequency footage data. An automatic bass feature permits monophonic bass tones to be played without having to play the pedals, and this is accomplished by coupling into the pedal data stream the lowest data bit originating from the Great manual. Transposition is accomplished by transposing the demultiplex latch command ahead or behind in time so that the data stream is latched either early or late by one or more time slots depending on the amount of transposition selected. A fold circuit injects keydown pulses into the data stream in octavely related time slots ahead of those time slots which are transposed outside the available stages of the demultiplexer when the serial to parallel conversion occurs.

15 Claims, 23 Drawing Figures

92
94
MASTER TONE GENERATOR
12 TONES OUT
SUSTAIN SWITCHES (BINARY ENCODED)
ATTACK SWITCHES (BINARY ENCODED)
TL
KEYER CHIP#1
KEYER CHIP#2
KEYER CHIP#3
12 TONES IN
12 TONES OUT
S.D.
LATCH
HF CK/R
S.D. OUT
SERIAL DATA
HF CLOCK + RESET
LATCH
SERIAL DATA
BUS AMPLIFIERS
VOICING
FET TABS
AMP
180
182
184
186
188
190
192
194
196
198
200
202
204
206
212
214
216
218
220
222
224
228
230
234
236
238
240
242
244
246

ENVELOPE
TONE
TONE OUT ÷4
LOW OCTAVE ENVELOPE GENERATOR
ENVELOPE GENERATOR
HIGH OCTAVE
KEYER
16' LOW OUT
16' HIGH OUT
8' LOW OUT
8' HIGH OUT
4' LOW OUT
4' HIGH OUT
2' LOW OUT
2' HIGH OUT
VDD
MR
TONE IN
VENV.
HIGH OCTAVE KEYING SIGNAL
LOW OCTAVE KEYING SIGNAL

MULTIPLEX CONTROL

AUTOMATIC BASS
GREAT DATA FROM MPX CONTROL
164
1/2'
940
941
958
WINDOW
START = 1
944
943
START
946
STOP
960
COUNT DECODER
K4
T7
942
K2
952
PRESET
948
DUAL 4 BIT COUNTER
CK
CK
Vdd
954
COUNT 232=0
956
950
MPX CK
963
166
702
705
GREAT 2' DATA
704
700
PEDAL DATA
964
965
SHIFT REGISTER
968
971
970
713
2'
120
972
SHIFT REGISTER
712
711
710
4'
8'
16'
1'
PEDAL DATA OUT

PLURAL MANUAL ORGAN HAVING TRANSPOSER

BACKGROUND OF THE INVENTION

The present invention relates to an electronic organ of the institutional or classical type intended to simulate a pipe organ, and in particular to a transposition circuit therefor.

Present-day electronic organs generally fall into three classes: smaller home organs which are voiced to simulate a wide range of modern instruments but are not designed to closely simulate a pipe organ, electronic theater organs which simulate the characteristic sound of a theater pipe organ, and institutional or classical organs which simulate pipe organs generally found in churches and concert halls. Although classical pipe organ literature is best played on a true pipe organ, such organs are very expensive and require frequent maintenance to maintain the pipes in tune. Furthermore, changes in humidity and temperature affect the operation and sound of the organ, and the number of technicians who can maintain and tune pipe organs is rapidly dwindling. Consequently, pipe organs have become so expensive that they are beyond the means of most musicians and many churches.

In order to permit classical literature to be played, electronic organs have been developed which simulate, to varying degrees of closeness, the sound of a pipe organ. One approach is to utilize a pure digital system wherein the sounds produced by the various instruments are digitally stored in memories which are then addressed at a variable rate depending on the keys depressed to produce the tones of the instruments at the frequencies desired. Systems of this type have unique problems which prevent them from being completely satisfactory, however. Firstly, the number of harmonics as a function of the frequency of the wave form varies somewhat because of the limited number of sample points at low frequencies, and, secondly, aliasing is a significant problem. Other organs of this type utilize pure analog techniques where individual tone generators produce the various voices and complex switching arrangements are utilized to key the various tones. The circuitry and switching arrangement for such an organ is extremely complex and unwieldy, however, and this greatly increases the physical size and cost of the organ as well as posing significant maintenance problems. The third approach, and that which is employed in the present system, is to combine digital and analog techniques to utilize the advantages inherent in each of them.

In a pipe organ or an electronic organ simulating a pipe organ, the upper manual is referred to as the Swell manual because the volume of those voices was traditionally controlled by a swell chamber having a series of shutters which opened and closed under the control of the organist. The lower manual is referred to as the Great manual, and it, like the Swell manual, comprises sixty-one keys. The pedal manual comprises thirty-two pedals arranged in a convex pattern. The voice controls are referred to as stops and take the form of rocker tabs, blade-type tabs or drawbars.

Such organs also include a particular type of special effect control known as couplers, both intermanual and intramanual. Intermanual couplers enable voices normally assigned to one manual, including the pedalboard, to be played on another manual. For example, the pedalboard can be caused to play voices assigned to certain ranks of the Great manual, or the Swell manual may be coupled to the Great manual and vice versa. Intramanual couplers, on the other hand, enable expansion of the basic rank of pipes. For example, if an eight foot flute voice is played on the Great manual, and the four foot Great to Great coupler is activated, the organ will produce both the eight foot flute and the four foot flute. Likewise, if the sixteen foot Great to Great coupler is actuated, a sixteen foot flute will also be played.

A technique which is often employed in pipe and electronic organs is referred to as unification, which permits more ranks of pipes or voices to be produced without duplicating each pipe or voice in the rank. For example, a rank of diapasons at the eight foot level requires sixty-one pipes, and in a non-unified system, to add a rank of four foot diapasons, an additional sixty-one pipes would be necessary, for a total of one hundred twenty-two pipes. However, of the five octaves of four foot diapasons, four of them are exactly at the same pitch as the original eight foot rank diapasons, so that there are forty-eight redundant pipes. In a unified system, then, for each additional footage, only twelve pipes or keyers are added, so that for the combined two foot, four foot, eight foot and sixteen foot ranks, a total of only ninety-seven pipes or keyers are necessary. The disadvantage to this is that the chorus effect is not as pronounced, but this is offset by the very substantial cost savings.

Pipe organs are capable of producing voices known as mixtures, which comprise two to five or more pitches produced simultaneously by depressing a single key. The pitches are generally unison and mutation pitches, so that a 1 3/5 foot mixture comprises a 2 foot pitch, a 1 3/5 foot pitch, and a 1 foot pitch, for example. The rank of the mixture determines the pitches that are played, so depending where on the manual the key is depressed; the mixture will comprise either two unison and one mutation, as in the previous example, or two mutations and one unison. In this latter case, the mixture would comprise, for example, a $1\frac{1}{3}$ foot pitch, a 2 foot pitch, and a $2\frac{2}{3}$ foot pitch.

In an electronic organ of the type in question, there are, of necessity, a large number of interconnections between the manuals, keyswitches, couplers, stops, keyers and tone generators, which results in a very complex system. Such complexity greatly increases the cost of manufacturing and maintaining the organ and provides numerous opportunities for malfunctions to develop. In an attempt to reduce the complexity of electronic organs of this type, digital multiplexing techniques have been utilized wherein the manuals are scanned either sequentially or simultaneously to produce one or more serial data streams having keydown pulses in time slots corresponding to depressed keys of the manuals. A beneficial result of multiplexing is that the serial data streams can be manipulated to achieve coupling and footage generation. In the generation of footages, the data streams are selectively delayed in shift registers or the like so that keydown pulses are added to the data streams in those time slots corresponding to the footages desired, whether octavely or sub-octavely related. This technique of footage generation requires additional time slots in the data streams following scanning of the last key of each manual.

A feature which is often included in institutional organs is a transposer, which permits the key of the instrument to be changed to match music which is being played or sung together with the organ. For example, if a choir cannot easily sing a piece of music in the key that it is written, in the absence of a transposer, the organist would have to mentally transpose the music by one or more half steps, which requires a very high degree of skill. In earlier prior art organs, both true pipe organs and electronic organs, automatic transposition was accomplished by mechanically altering the physical relationship between the keys and the switches or other mechanical actuators which were operated when they were depressed. For example, the physical relation between the middle C key and the switches is changed so that when this key is depressed, the switch pertaining to C# would be actuated, in the case of transposition one-half step sharp. As will be appreciated, there is considerable mechanical complexity involved in providing for automatic transposition in this manner.

Further developments of automatic transposers involve the use of a variable frequency master oscillator which affects the frequencies of all of the divider outputs in the organ so that the absolute pitches of the tones will change but the relationship between the tones will remain constant. A disadvantage to this technique, however, is the instability of such a generator.

With the application of standard multiplexing techniques to the electronic organ field, the keyboard is scanned and a time division multiplexed serial data stream produced wherein keydown pulses appear in time slots corresponding to depressed keys of the keyboard. In organs of this type, transposition is accomplished by delaying the serial data stream by one or more time frames so that when the data is demultiplexed, the keydown pulses appear in time slots corresponding to those keys spaced from the depressed keys by the amount of transposition. A drawback to this technique is that, if it is desired to transpose in a direction opposite to that of the direction of scanning, an excessively long delay line is necessary. For example, if the keyboard is scanned from high to low, transposition flat can easily be accomplished by delaying the data stream by one or more time frames. If it is desired to transpose sharp, however, the data stream must be delayed until the next scan so that the keydown pulses appear in time slots which are perceived to occur before the original time slots. Since one stage of delay is required for every key of the manual, the delay line can become quite long, which adds to the cost of the organ.

A further disadvantage to the data stream delaying technique for accomplishing transposition is the difficulty of delaying each data stream by an equal amount in the case of plural manual organs wherein the serial data streams for the respective manuals are synchronized. A classical-type organ, for example, requires that the data stream from one manual be combined with the data streams from the other manuals so that synchronization thereof is necessary. Since a plurality of data streams must be delayed, and delayed by an equal amount, transposition thereof becomes unwieldy.

A further prior art technique for accomplishing transposition in a multiplexed organ is to delay the synchronizing or latch pulse signal which controls the serial to parallel conversion. Again, if transposition is in a direction opposite to the direction of scanning, very long delay times are required.

A problem with transposition in a multiplexed system is that it is possible to transpose some of the keydown pulses to time slots outside the range of tones which are capable of being played by the organ. For example, if the manual is scanned from high to low and the sixteen foot or thirty-two foot tone is being played by depressing the lowest key on the manual, transposition of this note flat by even one time slot would carry it outside the range of the organ. Thus, there would be no stages in the demultiplexer for a keydown pulse occurring at this time. If no extra time slots are provided at the upper and lower ends of the data stream, then transposition on the end of the data stream would cause the note to sound at the opposite end of the musical scale encompassed by the manual. One prior art attempt to solve this problem is to fold the actual tones which are produced to an octave higher or lower as by a switching matrix. A disadvantage to this solution, however, is that a number of switches are required to accommodate the various amounts of transposition, and any switching which is accomplished in the output circuitry of the organ is likely to cause undesirable transients.

SUMMARY OF THE INVENTION

The problems and disadvantages of the prior art discussed above are overcome by the transposition system of the present invention wherein the time at which the latch command signal is developed is controlled by decoding a particular multiplex timing signal. As the keys of the manuals are multiplexed, a series of digital signals are produced pertaining to the corresponding keys of the Swell, Great and Pedal manuals. Under normal conditions with no transposition selected, the timing or driver pulse corresponding to that time when the data streams are loaded into the proper stages of the demultiplexer shift register is decoded. This produces a latch control signal which latches the serial data to the demultiplexer stages and causes keying of those tones corresponding to the time slots in which the keydown signals appear.

If the data streams are to be transposed one-half step sharp, for example, the timing or driver signal immediately following the normal timing signal is decoded so that the serial to parallel conversion occurs one time slot late. This has the effect of placing the keydown pulses in those stages of the demultiplexer which are normally occupied by the keydown pulses one-half step sharp so that tones one-half step sharp are played. To transpose the data by one-half step flat, the timing signal occurring just before the normal timing signal is decoded and the serial data will be latched one time slot early, which latches the keydown pulses into stages of a demultiplexer assigned to key those tones which correspond to the keys of the keyboard one-half step lower than the keys which are depressed.

Folding is accomplished by monitoring the amount of transposition and decoding one or more of the timing signals occurring within an octave near the lower end of the manual to permit keydown pulses to be injected into the data stream one octave higher than they are played if the keydown pulses corresponding to the played keys would be transposed out of the range of the organ.

The advantage to transposing in this manner is that it greatly simplifies the control of transposition even though there may be as many as five different data streams which are being separately demultiplexed. Furthermore, transposition in a direction opposite to the direction of scanning can be accomplished simply by selecting the next timing signal, and without the necessity for providing a long delay line to delay either the data stream or the latch command to the next scan.

Folding can be accomplished by operating on the digital multiplexed data itself, without the necessity for resorting to complicated switching arrangements for modifying the keyed tones themselves.

Specifically, the present invention contemplates an electronic organ comprising a plurality of manuals each having a plurality of playing keys, a multiplexer for scanning the manuals simultaneously to produce a plurality of synchronized respective serial data streams each comprising a plurality of time slots corresponding on a one-to-one basis to the keys of the respective manual and having keydown signals in the time slots of the depressed keys. The demultiplexer has a plurality of stages corresponding respectively to tones capable of being played by the organ and having one or more data inputs to which the data streams are connected and one or more latch control inputs. The demultiplexer shifts the data stream through its stages and converts it to parallel format under the control of the latch signal on the latch control input to cause the keydown signals to latch in the stages in which they are present at the time of serial to parallel conversion to thereby key tones corresponding to the stages in which the keydown signals are latched. The multiplexer generates in succession a plurality of multiple bit digital timing signals synchronized with and corresponding respectively to the time slots of the synchronized data streams. The improvement is a transposer comprising a decoder for decoding any one of a plurality of the digital timing signals occurring near the end of the scan of the manuals and producing the latch control signal in synchronism with the occurrence of said any one timing signal to cause the demultiplexer to convert the data streams into parallel format at that time. The transposer includes a player operated selector for selecting said any one timing signal from among the plurality of such signals occurring near the end of the scan of the manuals to change selectively the time of serial to parallel conversion to thereby transpose the keydown pulses to different stages of the demultiplexer at the time of serial to parallel conversion.

The present invention also contemplates an electronic organ wherein the demultiplexer demultiplexes the data stream and keys tones corresponding to the signals in the data stream, and has a transposer for transposing the keydown signals including a player operated selector for selecting a given amount of transposition and selectively modifying the timing relation between the serial data stream and the demultiplexer such that the keydown signals cause keying of tones corresponding to keys differing from the depressed keys by the amount of transposition. The improvement is a fold circuit for ensuring that the keydown signals are not transposed outside the range of tones capable of being keyed by the organ which comprises means for monitoring the amount of transposition selected by the selector and injecting a keydown signal into a time slot in the data stream octave away from the time slot of any keydown signal which would be transposed outside the range of tones capable of being keyed by the organ.

DESCRIPTION OF THE PREFERRED EMBODIMENT

Figures 1, 1A:
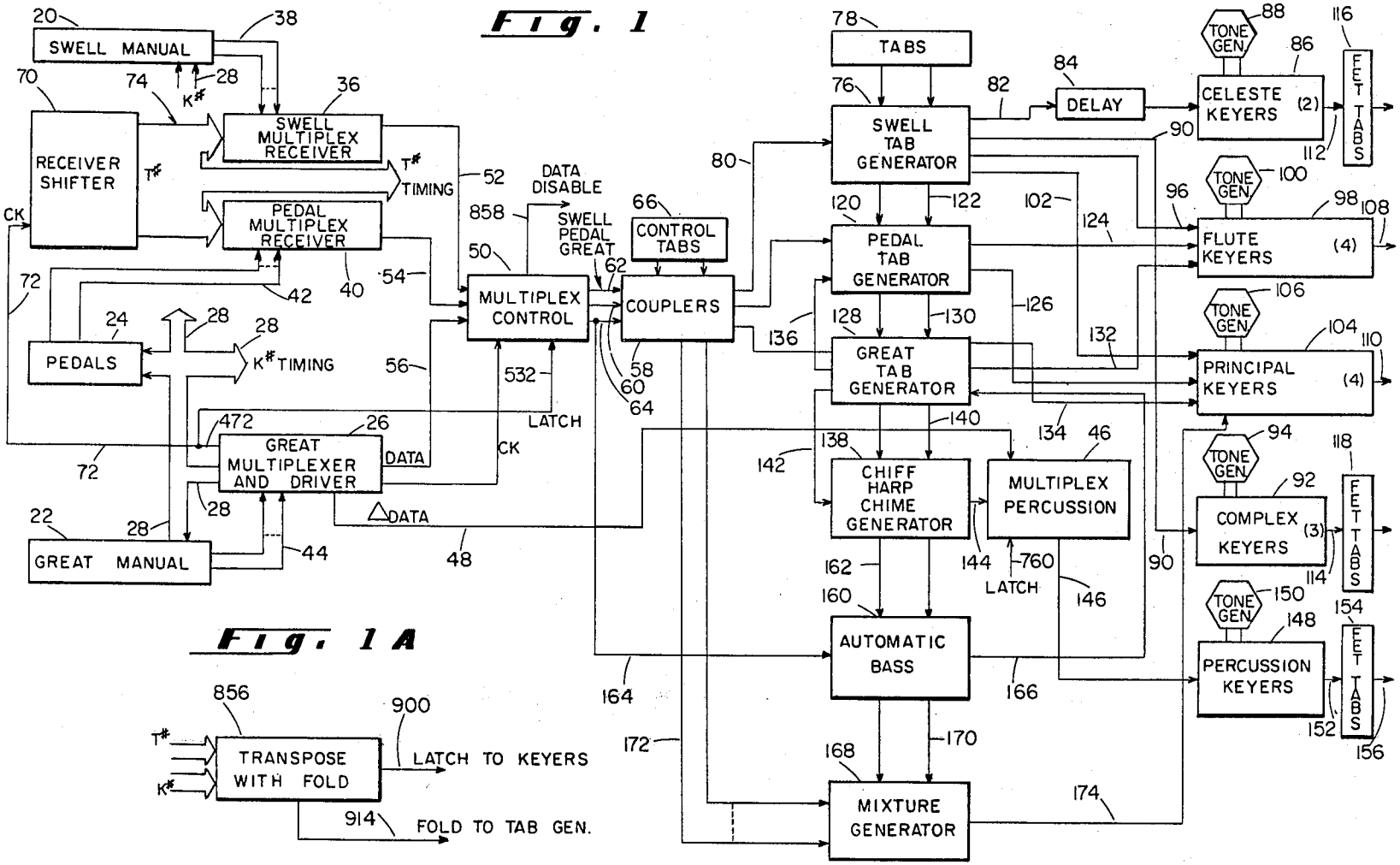
FIG. 1 is a general block diagram for the digital front end of the multiplexed plural manual organ of the present invention.
FIG. 1A is a block diagram of the transpose and fold circuit.

With reference to FIG. 1, the organ comprises a Swell manual 20, a Great manual 22, each of which comprises sixty-one keys, and a thirty-two note pedalboard 24. The Swell manual 20, Great manual 22 and pedalboard 24 are multiplexed in parallel by means of Great multiplexer and driver 26, which produces, on lines 28, a parallel, eight bit wide driver signal. The driver signals are connected to Swell manual 20, to pedalboard 24, and to Great manual 22 over lines 28.

For ease in referencing, the driver signals, which are actually a series of eight bit binary words wherein only one bit location is high at any one time, are referred to as "K" numbers or "K" drivers.

Swell manual 20 is connected to swell multiplex receiver 36 over eight lines 38, and pedalboard 24 is connected to Pedal multiplex receiver 40 over lines 42. The Great multiplexer and driver 26 also includes the receivers for Great manual 22, which are connected to it over eight lines 44. The reason for selecting the Great multiplexer 26 as the receiver, is that it must produce the delta data pulse, which is generated each time there is a new depressed key on great manual 22, and is connected to the multiplex percussion block 46 over line 48.

Although the same "K" drivers are used for all three manuals, the receivers are separate, and the outputs of receivers 36, 40 and 26 are the actual data streams, with a separate data stream for the Swell manual 20, the Great manual 22 and the pedalboard 24. The data streams from Swell multiplex receiver 36, pedal multiplex receiver 40 and Great multiplex receiver 26 are connected to multiplex control block 50 over lines 52, 54 and 56, respectively. Multiplex control block 50 causes data to be output on alternate scans of the manuals, even though data is being inputted to it on each scan. As discussed earlier, the use of a double scan wherein data is outputted on every other scan enables the lower frequency footages to be generated by means of serial data stream delay techniques.

The Swell data stream from multiplex control 50 is connected to the coupler block 58 over line 60, the Pedal serial data stream is connected thereto over line 62 and the Great serial data stream over line 64. The couplers 58, which are controlled by tabs 66, enable the Great data on line 60 to sound as though it were played on the Swell manual, or enables data generated by the pedalboard, which data is connected to couplers 58 on line 62, to sound as though it were played on the Swell or Great manuals. This type of coupling is known as Intermanual coupling wherein the notes played on one manual are voiced in accordance with the voicing selected for another manual.

The other type of coupling utilized in large organs is known as intramanual coupling wherein notes played in one frequency range of a manual sound in either a higher or lower frequency range. For example, by delaying data which would normally sound in the eight foot range by twelve time frames, it will sound one octave lower in the sixteen foot range, because the manuals are scanned downwardly from the high end. If the data were advanced twelve time frames, then it would sound in the four foot range.

Returning now to the multiplexing circuitry, eight bit receiver shifter 70, which is an eight bit shift register, is synchronized by a pulse from great multiplexer and driver 26 on line 72, and produces on eight output lines 74 a series of eight bit binary numbers when the eight bit locations individually go high in succession. The eight bit locations of the receiver shifter outputs go high in succession for each change of state in the "K" numbers at the output of Great multiplexer and driver 26. The eight bit locations of receiver shifter 70 outputs 74 are referred to as "T" numbers. Thus, the various combinations of the "K" numbers and "T" numbers produce sixty-four separate states, which is more than adequate for the sixty-one notes of the Swell manual 20 and Great manual 22.

Swell tab generator 76, which is controlled by tabs 78, generates the various footages by delaying the serial data stream on input line 80 similar to the data shifting principle disclosed in U.S. Pat. No. 3,951,028, which is owned by the assignee of the present application. Swell tab generator 76 has four outputs, the first output 82 being connected through delay 84 to two celeste keyer blocks 86. Tone generator 88 is connected to keyers 86. The second output 90 from Swell tab generator 76 is connected to three complex keyer blocks 92, which are fed with tones from tone generator 94. Complex keyers 92 typically generate reeds and trombones, and utilize square wave voicing. Output 96 from tab generator 76 is connected to a bank of four flute keyers 98 supplied with tones from tone generator 100, and output 102 is connected to a bank of four principal keyers 104, which are supplied with tones from tone generator 106.

Keyers 86, 98, 104 and 92 basically demultiplex the multiplex serial data streams at their respective inputs and produce the appropriate tones on their outputs. For example, if the sixteen, eight, four, two and one foot tabs 78 Swell tab generator 76 are actuated, five pulses will appear in the data streams on outputs 82, 90, 96 and 102 for the depressed key, and these will be demultiplexed by the keyer banks 86, 98, 104 and 92 to produce sixteen foot, eight foot, four foot, two foot and one foot tones. The outputs 108 and 110 of keyer banks 98 and 104 are connected directly to the voicing circuitry (not shown), but the outputs 112 and 114 of celeste keyers 86 and complex keyers 92 are connected through FET tabs 116 and 118. Normally, the outputs of the keyers 86, 98, 104 and 92 have footages at sixteen foot, eight foot, four foot and two foot from each octave available, and FET tabs 116 and 118 enable a particular footage to be selected. In the flute keyer bank 98 and principal keyer bank 104, however, the footage generation is accomplished by tabs 78 in conjunction with swell tab generator 76 and the other tab generators to be described below.

The delay 84 for celeste keyer 86 is because the two celeste keyers 86 each only have a capacity of twenty-four bits of serial data, whereas the swell manual 20 and great manual 22 each have sixty-one keys. The delay provides a delay of thirteen bits so that the data does not shift through the celeste keyers 86 before latch command. If it would be desired to play the lowest thirteen notes of the swell and great manuals, which notes are effectively eliminated by delay 84, it would be necessary to add a third celeste keyer and eliminate delay 84. It will be noted that the flute keyer bank is provided with four keyers each having a twenty-four bit capacity, the principal keyer bank 104 is provided with four keyers each having a twenty-four bit capacity, and the complex keyer bank 92 is provided with three keyers each having a twenty-four bit capacity.

The pedal tab generator 120, which is also controlled by tabs 78 over lines 122, has a first output 124 connected to the flute keyer bank 98 and a second output 126 connected to the principal keyer bank 104. Great tab generator 128, which is controlled by tabs 78 over lines 130, has a first output 132 connected to the flute keyer bank 98 and a second output 134 connected to the principal keyer bank 104. Great tab generator 128 also has an output 136 comprising three lines having pulses at the two foot, four foot and eight foot time slots, which are connected to a collector in the Pedal tab generator 120.

Chiff-harp-chime tab generator 138, which is controlled by tabs 78 over lines 140, is provided with eight foot serial data from the Great tab generator 128 over line 142. Its output 144 is connected to multiplex percussion block 46, which has a serial data output 146 connected to a bank of two percussion keyers 148, supplied by tone generators 150. The output 152 of percussion keyer bank 148 is connected through FET tabs 154 to the output line 156. Multiplex percussion block 46 produces a burst of serial data under the control of a delta data pulse on line 48, which is substantially longer in time than a scan of the keyboard, and produces a transient envelope characteristic of percussive sounds, such as those produced by a harp or chimes or the chiff characteristic of the pipe organ sound.

The auto bass generator 160 is controlled by tabs 78 over lines 162 and receives its input data from the Great serial data line 64 over line 164. This block is intended for persons not sufficiently skilled to play the pedals 24, and it monitors the lowest two octaves of the Great serial data on line 64 and inserts a pulse into the Great tab generator 128 over line 166 corresponding to the lowest key played on the great manual 22. It has been found that this technique produces a very pleasing pedal sound, although the versatility of selective playing of the pedals 24 is lacking.

The mixture generator 168 is controlled by tabs 78 over lines 170 and receives data from couplers 58 over lines 172. As discussed earlier, the mixture generator plays three footages by selecting only a single tab. For example, if a C key is pressed, the organ will play the C as well as the G above and below it, or the G note with the C notes on either side of it, depending on the octave in which the key is depressed. In the top two octaves, for example, the unison will sound as well as the $1\frac{1}{3}$ and $\frac{2}{3}$ mutations, which corresponds to the notes G, C, G with a C key depressed. In the next octave, the unison as well as its first harmonic will sound together with the $1\frac{1}{3}$ mutation, which corresponds to the C, G, C keys with a C key depressed. In the next higher octave, the unison sounds together with the $1\frac{1}{3}$ mutation and $2\frac{2}{3}$ mutation (keys G, C, G) and in the highest octave, the unison, its first harmonic and the $2\frac{2}{3}$ mutation (C, G, C) will sound. The output from the mixture generator 168 is connected over line 174 to the principal keyer bank 104.

To summarize the block diagram illustrated in FIG. 1, the Swell manual 20, Great manual 22 and Pedal manual 24 are multiplexed in parallel fashion and connected to the respective inputs of multiplex control block 50. This passes the multiplexed data on alternate scans of the manuals and connects the serial data streams to the inputs of couplers 58. Couplers 58 route the serial data selected by the three manuals to the Swell tab generator 76, Pedal tab generator 120, Great tab generator 128 and mixture generator 168. The tab generators comprise a plurality of shift registers which delay the incoming data to produce the various footages, which are selected by tabs 78. The chiff-harp-chime generator receives data of the appropriate footage from the great tab generator 128 and transmits it to multiplex percussion block 46, which provides a data burst on line 146 to simulate a percussive envelope. The time of the data burst is controlled by the data delta pulse on line 48, which is generated by great multiplexer and driver 26 each time a new key is depressed. The auto bass block 160 receives its data directly from the great data stream on line 164, and transmits a single pulse of data to Great tab generator 128 which corresponds to the lowest note played on the Great manual. Great tab generator 128 routes this data to the appropriate keyer bank. The outputs of the tab generators are connected to the appropriate keyer banks 86, 98, 104, 92 and 148 wherein the serial data streams are demultiplexed and the corresponding tones appear on their respective outputs. Celeste keyers 86 and complex keyers 92 are provided with tab switching 116 and 118 on their outputs to select the desired footages.

Keyer banks 86, 98, 104, 92 and 148 will now be described. Each of the keyer banks comprises two, three or four individual keyer blocks as indicated in FIG. 1, and the keyer banks are the subject of U.S. Pat. No. 4,217,801. Basically, the keyer banks are comprised of individual keyer chips which may be interconnected in building block fashion to accommodate manuals of any length, and may be expanded as desired to accommodate the higher frequency footages, which are generated by a data delay technique described in the aforementioned U.S. Pat. No. 3,951,028.

Figure 2:
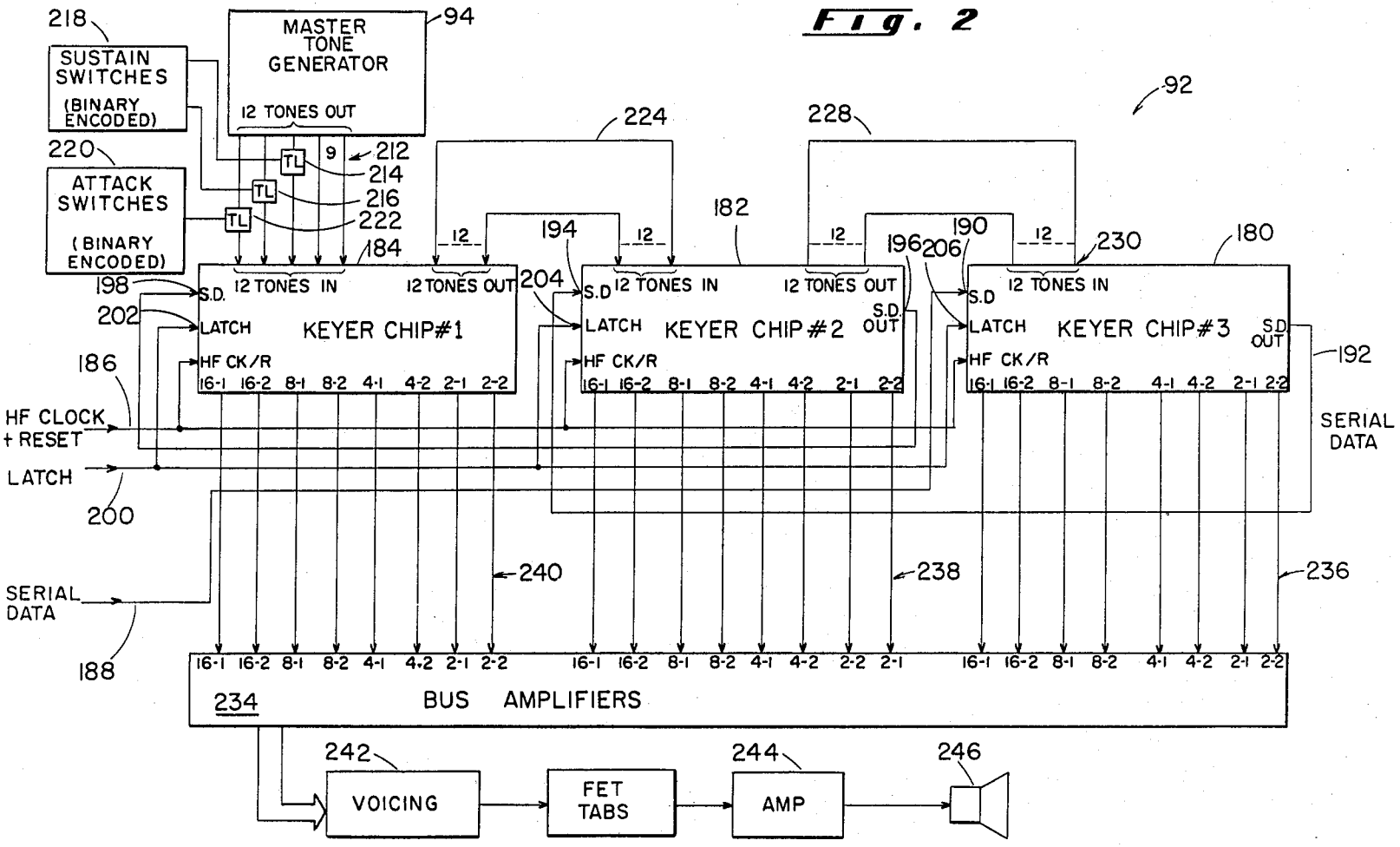
FIG. 2 is a general block diagram of one of the keyers.

Referring now to FIG. 2, the complex keyer bank 92 will be described, although each of the other keyer banks are similar except that they may comprise more or less individual keyer chips in the bank, as indicated in FIG. 1. Keyer bank 92 comprises three keyer chips 180, 182 and 184, which are connected in series. The high frequency multiplex clock signal and reset signal are combined on line 186 and connected to a tri-level input on each of chips 180, 182 and 184 so that the clocking and reset functions can be combined on a single line.

The serial data stream on line 188 comprises time slots corresponding on a one-to-one basis with the depressed keys of the manuals and contains keydown signals, customarily in the form of pulses, in time slots corresponding to depressed ones of the keys. This time division multiplexed data stream is fed to the serial data input 190 of keyer chip 180 in which it is delayed two octaves and then fed out on serial data output line 192. Each of keyer chips 180, 182 and 184 corresponds to two adjacent octaves, and it is for this reason that the serial data stream is delayed by time slots equaling two octaves. It will be recalled that the manuals are scanned in a downward direction beginning with the highest key and ending with the lowest key thereof, and it is for this reason that the serial data stream is first fed to keyer chip 180.

The delayed serial data stream on output 192 is connected to the serial data input 194 of chip 182, delayed by a period of two octaves, and fed out on output 196 to the serial data input 198 of keyer chip 184. In each of the keyer chips 180, 182 and 184, the serial data stream flows through a twenty-four bit shift register for demultiplexing and delay purposes. At the appropriate time in the scans of the manuals, a latch pulse appears on line 200, which is connected to the latch inputs 202, 204 and 206 of the keyer chips. At this time, chip 184 contains the top two octaves of the data, chip 182 the next two octaves, and chip 180 the last two octaves, wherein the data corresponds to the keys depressed. It will be recalled that the footages for complex keyer bank 92 are not selected by the swell tab generator 76, but are selected by FET tabs 118 on its output, The latch signals on inputs 202, 204 and 206 cause the internal latches within the chips to be clocked thereby transferring the keydown data to the individual keyers.

The tones are generated by a master tone generator 94 and supplied to keyer chip 184 over twelve input lines 212. Two of these lines include tri-level encoders 214 and 216 connected thereto which encode the tone signals with the binary encoded sustain switch data from switches 218, thereby avoiding the necessity for utilizing a second pair of pins for switches 218. In a similar fashion, attack switches 220, which are also binary encoded, are connected to chip 184 on the same line with one of the tones by means of tri-level encoder 222.

The twelve tones, which may be produced by a top octave synthesizing technique or by individual oscillators, are generally in the 8,000 Hz. to 4,000 Hz. range. The tones on lines 212 are divided by a factor of four in chip 184 so as to lower them by two octaves and then fed out on lines 224 to the tone input pins 226 of keyer chip 182 with the tri-level inputs. These tones are further divided in frequency by a factor of four to lower them an additional two octaves and fed out over lines 228 to the tone input pins 230 of keyer chip 180. By this successive frequency division of the tones, they are at the proper frequencies for the octaves related to the respective chips 180, 182 and 184.

Each of the chips includes sustain-type keyers wherein the keying envelope is selected by switches 218 and 220. The keyed tones at a footage for each of the pitches of the respective octaves are bussed together and fed to bus amplifiers 234 over lines 236, 238 and 240, respectively. The outputs from the bus amplifiers 234 are connected to voicing circuits 242 which are selected by tab FETs 118 and then through amplifier 244 to speaker 246.

Figure 3:
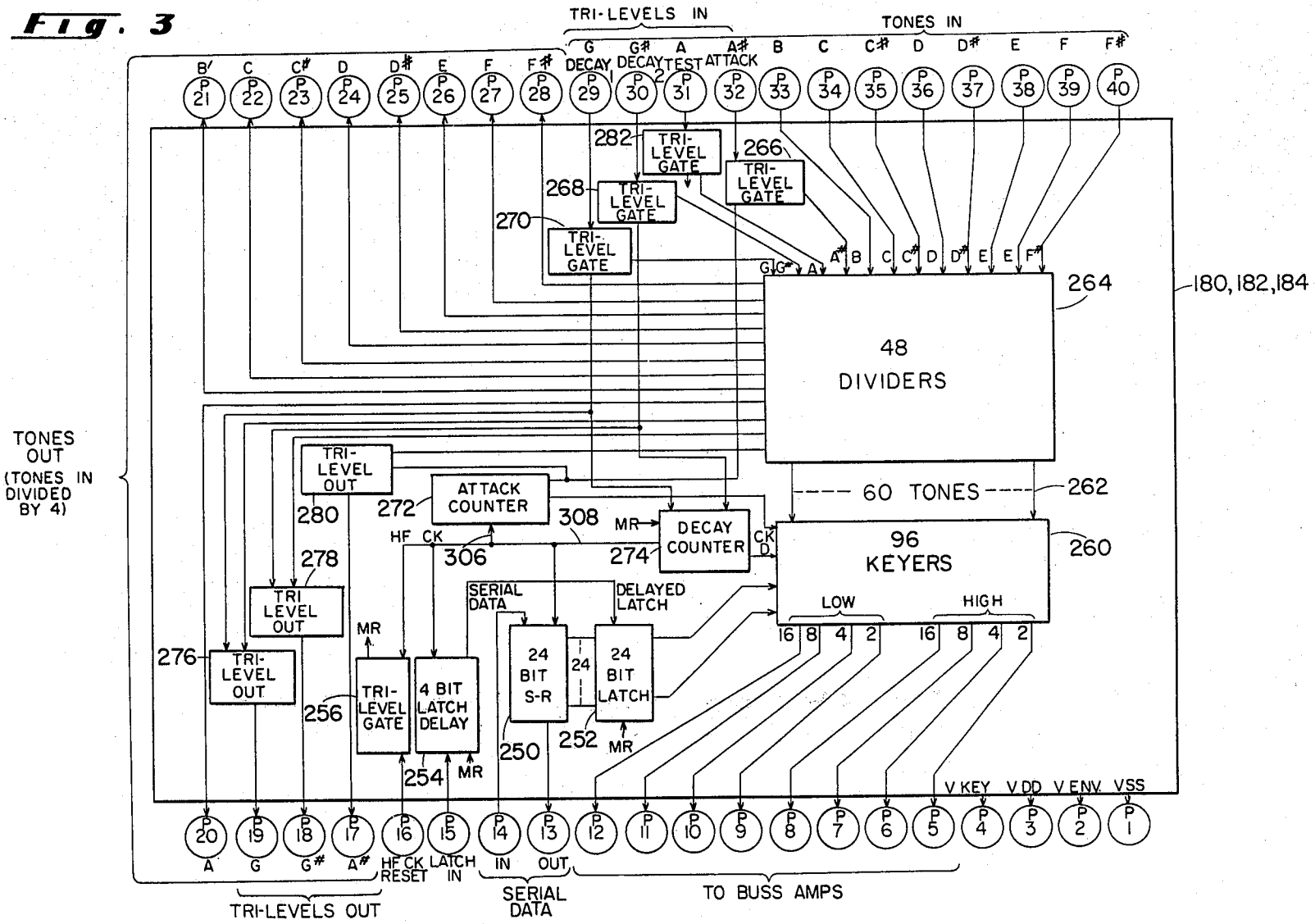
FIG. 3 is a more detailed block diagram of one of the keyer chips of FIG. 2.

Referring now to FIG. 3, one of the chips 180, 182 and 184 is shown in greater detail. The serial data stream on pin P14, which may be received either directly or from the serial data output pins of one of the other keyer chips, is fed into twenty-four bit shift register 250, which in turn feeds a twenty-four bit latch 252. Latch 252 receives the latch command from four bit latch delay 254, which in turn is fed by the latch signal on pin P15, and is clocked by the high frequency multiplex clock train brought in on pin P16 and decoded by tri-level gate 256. The four bit delay for the latch signal caused by delay 252 is necessary to enable the data to completely fill the highest frequency keyer chip 184. Although the latch command is generated by the "K" and "T" numbers, and could presumably be chosen such that data would completely fill the highest frequency keyer chip 184, the particular chips utilized are adapted for use also with conventional latch command which occurs at the end of a scan, and for this reason, the four bit delay is present and must be compensated for in generating the latch command.

The master reset on line 258 is separated out by tri-level gate 256. Latch 252 feeds a twenty-four section sustain envelope generator block 260 generally of the type disclosed in U.S. Pat. No. 4,217,801. Envelope generators/keyers 260 are fed with sixty tones over lines 262 from forty-eight dividers 264, which produce the five octaves of tones necessary for the 16', 8', 4' and 2' footages for the two adjacent octaves keyed by the particular keyer chip 180, 182 or 184. Dividers 264 receive the twelve tones for a single octave over pins P29–P40 and, in addition to performing the above-discussed frequency division, pass these tones to keyers 260 and to tone output pins P17–P28. Tri-level gates 266, 268 and 270 separate out the attack and sustain commands for attack and decay counters 272 and 274, and tri-level encoders 276, 278 and 280 re-encode this data on tone output pins P17, P18 and P19. Tri-level gate 282 separates a test signal from the A tone.

Figure 4:
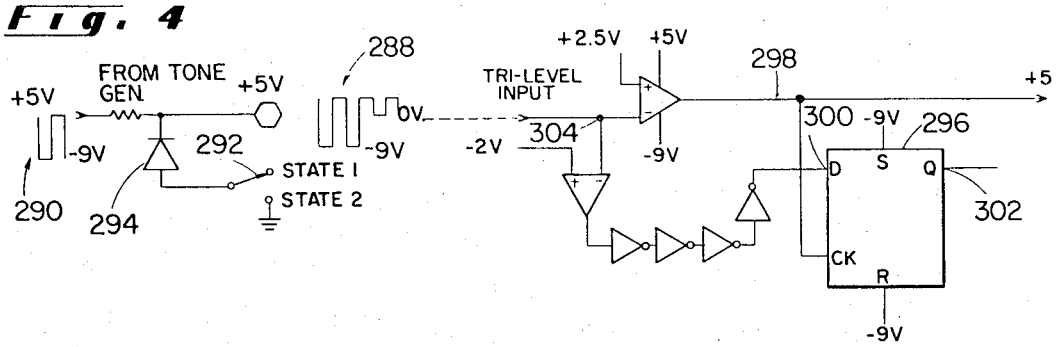
FIG. 4 is a schematic of a tri-level encoder and decoder.

FIG. 4 illustrates a typical tri-level gate wherein the tri-level signal 288 is produced by combining a high frequency signal, such as tone signal 290, with a static signal such as that produced by switch 292 as it switches between states one and two. In state two, diode 294 clamps the tone swing between +5 v. and 0 v., whereas in state one, tone signal 290 is permitted its full swing between +5 v. and −9 v. Decoding of the static signal may be accomplished by means of D-type flip-flop 296, which is clocked by the signal on line 298 and transfers the −9 v. signal on the D terminal 300 to the Q output 302 when the tri-level input on line 304 swings to −9 v.

Figure 5:
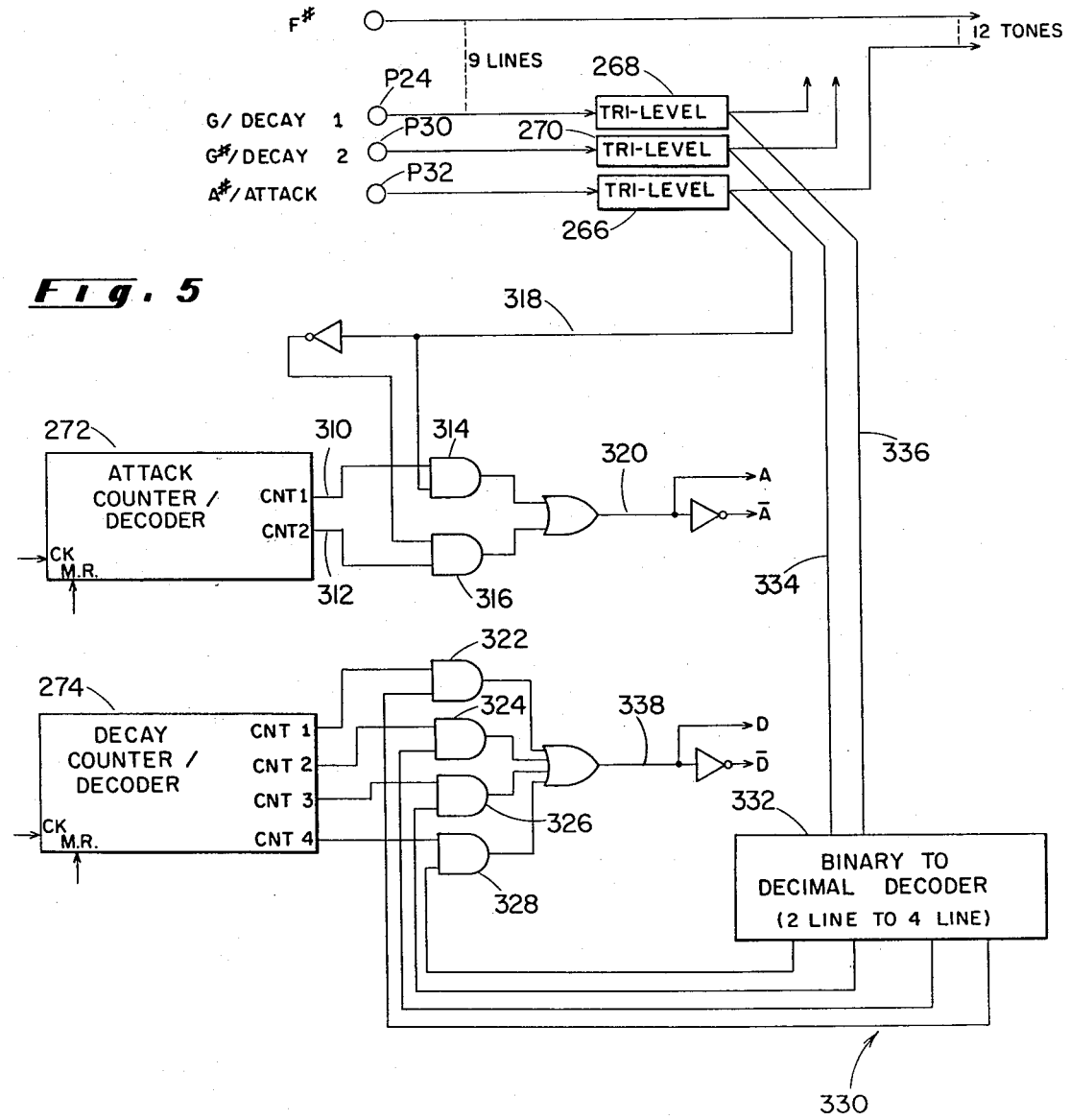
FIG. 5 is a block diagram of the variable counter system of one of the keyer chips.

With reference to FIG. 5, the circuitry for selecting the effective count lengths of counters 272 and 274 is shown. Counters 272 and 274, which may be of the polynomial counting type, shift register type, binary type or decimal type, are clocked by the high frequency clock pulse trains on lines 306 and 308 from tri-level decoder 256. Attack counter/decoder 272 has two outputs 310 and 312, which are connected respectively to one of the inputs of AND gates 314 and 316, the other inputs of which are fed by the inverted and non-inverted logic levels on line 318 leading from tri-level gate 266. With output 310 being the shortest count, when a logic level on line 318 is logic 1, AND gate 314 will be enabled and the pulse train on line 320 will be at the higher frequency. Conversely, when a logic level on line 318 is logic 0, AND gate 316 will be enabled and the pulse train on line 320 will be at the lower frequency. It should be noted that counter/decoder 272 may have more than two outputs so that the relative frequencies may have a ratio other than 2:1. The pulse train on line 320 is fed to inputs 389 and 392 of the circuit shown in FIG. 6 in both its inverted and non-inverted form.

Sustain counter/decoder 274 has four outputs which are fed respectively to one of the inputs of AND gates 322, 324, 326 and 328. As was the case with counter 272, the output connected to AND gate 322 is the least significant bit and represents the shortest count length, and the output connected to AND gate 328 is the most significant bit with the longest count length. The four outputs of counter 274 need not be four consecutive counts of the counter, but may be spaced as required by the particular sustain characteristics which are to be achieved. The other inputs of AND gates 322, 324, 326 and 328 are fed by outputs 330 from binary to decimal decoder 332. Decoder 332 is fed by a two bit binary word on lines 334 and 336 produced by tri-level gates 268 and 270. Depending on which of AND gates 322–328 is enabled, the pulse train on line 338 will have a correspondingly higher or lower frequency and, thus, four different sustains can be selected depending on the logic levels on pins P29 and P30. The pulse train on line 338 is connected to the inputs 391 and 393 of the circuit shown in FIG. 6 in its inverted and non-inverted forms, respectively.

Counter/decoders 272 and 274 feed twenty-four banks of four keyers each, wherein each of the four keyers produces one of the footages required by that particular note, for example, the 16', 8', 4' and 2' footages.

Figures 6, 6A:
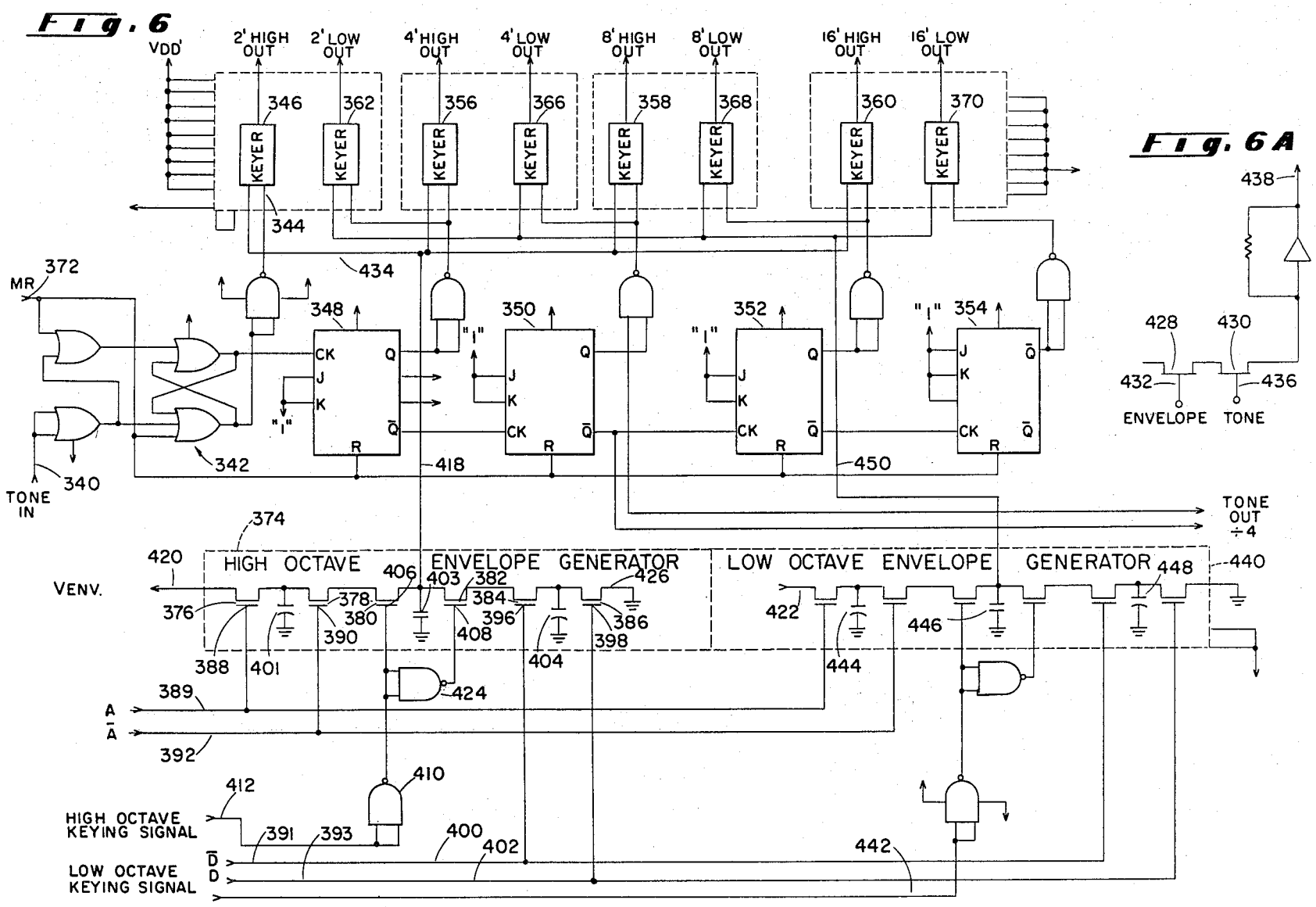
FIG. 6 is a schematic of a plurality of the keyers identified as a block in FIG. 3.
FIG. 6A is a schematic of one of the discrete keyers shown as a block in FIG. 6.

Referring now to FIG. 6 a portion of the keyer/divider combination 260, 264 shown generally in FIG. 3 will be described in detail. The tone, for example, the C# tone in the highest octave, is fed in from pin P35 on line 340 into R/S driver 342, which connects the tone to one of the inputs 344 of individual keyer 346. The tone is also fed through a series of divide-by-two dividers 348, 350, 352 and 254, which present tones at one of the inputs to keyers 356, 358 and 360 at the 4', 8' and 16' pitches. The 2', 4', 8' and 16' pitches for the C# tone in the next octave lower are accomplished by tying together the tone inputs of the 2' lower octave keyer 362 and the 4' higher octave keyer 356, by tying together the tone inputs of the 4' lower octave keyer 366 and the 8' higher octave keyer 358, and by tying together the tone inputs of the lower octave 8' keyer 368 and the 16' higher octave keyer 360. The 16' lower octave keyer 370 is fed directly by divider 354, and the master reset is brought in on line 372.

Envelope generator 374 for the higher octave C# tone comprises field effect transistors (FET) 376, 378, 380, 382, 384 and 386 having their sources and drains connected in series. The gate terminal 388 for FET 376 is fed by the non-inverted A output from attack counter 272 on line 389, whereas the gate 390 for FET 378 is fed by the inverted output $\overline{A}$ from attack counter 272 on line 392. The gates 396 and 398 of FET's 384 and 386 are controlled by the inverted and non-inverted pulse trains on lines 400 and 402, respectively, from decay counter 274.

The gates 406 and 408 of FET's 380 and 382 are controlled by the non-inverted and inverted outputs, respectively, from NAND gate 410, and when a keydown signal on line 412 is received from one of the latches 252 designating a particular depressed key, FET 380 will be enabled. Similarly, when the key is released and the opposite logic level is present on line 412, FET 380 will be disabled and FET 382 will be enabled. Thus, the attack characteristics are controlled by the frequency of the signals on lines 389 and 392, and the relative capacitances of capacitors 401 and 403. Capacitor 401 may have a capacitance of 0.001 microfarad, and capacitor 403 may have a value of 0.47 microfarads, for example.

The keying envelope is connected to the control inputs of keyers 346, 356, 358 and 360 over line 418. The envelope adjust voltage on lines 420 and 422 is controlled by a potentiometer (not shown) external to chips 180, 182 and 184, and serves to set the keyer current.

When a keydown signal is received on line 412, FET 380 will be turned on thereby providing a high conductivity path between FET 378 and capacitor 403. As FET 376 opens and closes, the voltage on line 420 will incrementally charge capacitor 401. Similarly, as FET 378 switches on and off, the voltage on capacitor 401 will discharge into capacitor 403 thereby raising the voltage level on line 418 incrementally and gradually over a period of time. As the transistors continue to oscillate between their on and off states, the voltage on capacitor 403 will generally charge towards the voltage level on line 420. The time interval required for the voltage on capacitor 403 to charge fully is determined by the frequency of the signal on lines 389 and 392, as developed by variable count length attack counter 272, and by the ratio values, rather than the particular sizes, of capacitors 401 and 403.

When the key is released and the logic level on line 412 returns to the opposite level, FET 380 will be disabled and FET 382 will be enabled, due to the inverting function of NAND gate 424, so that there is a path of high conductivity between FET 384 and capacitor 403. As FETs 384 and 386 are alternately enabled by the out-of-phase pulse trains on lines 400 and 402, capacitor 403 will incrementally discharge into capacitor 404, and capacitor 404 will discharge through FET 386 to ground on line 426. Thus, the voltage level on line 418 will gradually return to the lower voltage level so as to disable keyers 346, 356, 358 and 360.

FIG. 6A shows one possible configuration for keyers 346-370. It comprises a pair of field effect transistors 428 and 430 connected in series wherein the gate 432 of FET 428 is connected to line 434, which in turn is connected to control line 418 from envelope generator 374. The gate 436 of FET 430 is connected to line 344, which carries the highest frequency footage tone from line 340, in the case of keyer 346. Thus, when a tone is present and there exists a keying voltage, the keyed tone will appear on line 438, which is connected to bus amplifiers 234 (FIG. 2). When the key is released, the voltage decays out and the keyer will be turned on.

The lower octave envelope generator 440 functions identically to generator 374 and is controlled by the keying signal on line 442. Again, the attack characteristics are controlled by the frequency of the pulse trains on lines 389 and 392 and by the ratio of capacitors 444 and 446. The decay characteristics are controlled by the frequency of the pulse trains on lines 400 and 402 and by the ratio of capacitors 448 and 446. In this case, however, line 450 carries the keying signal and actuates the keyers 362, 366, 368 and 370, which pertain to the next lower octave.

Figure 7:
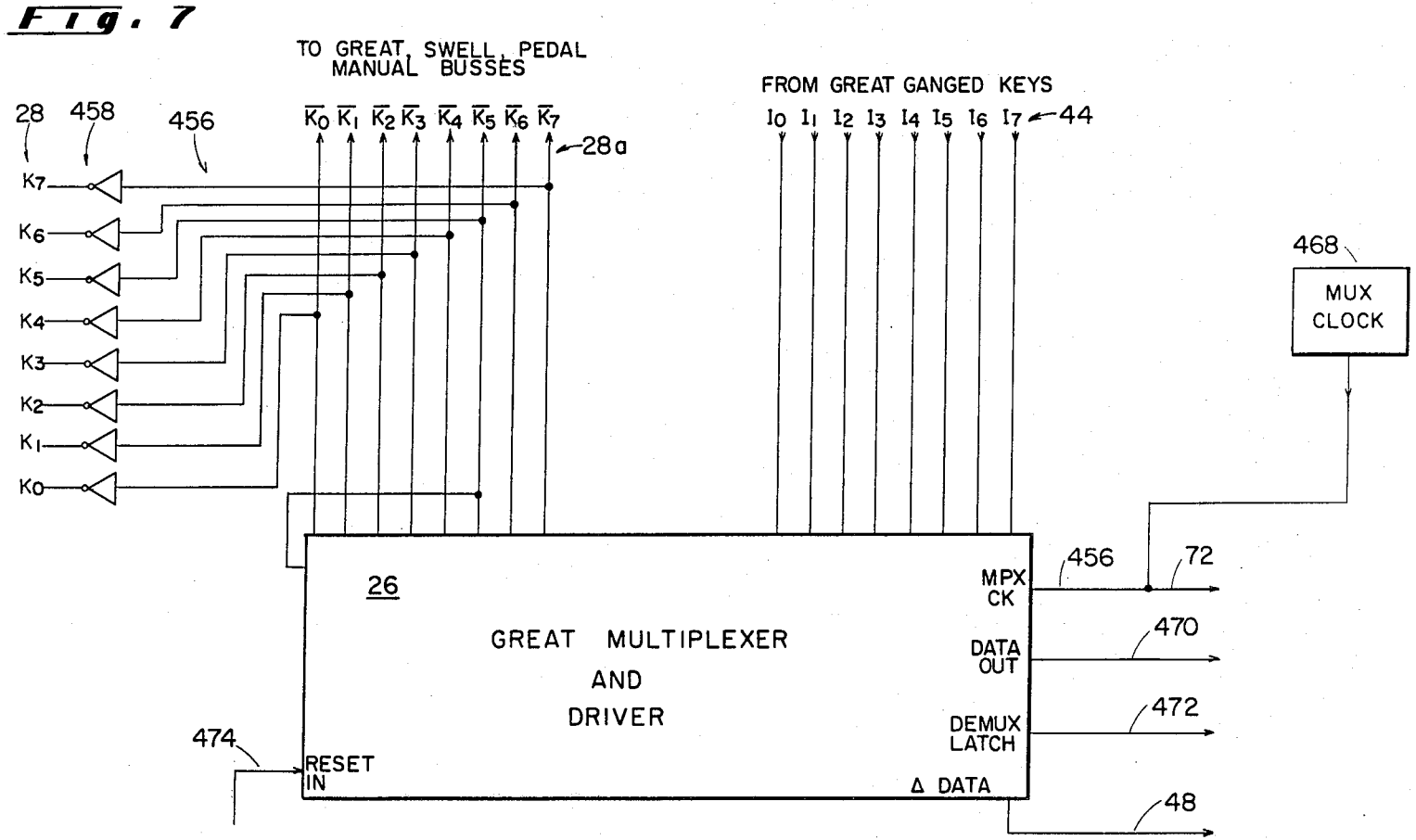
FIG. 7 is a schematic of the inputs and outputs for the Great multiplexer and driver.

The multiplexing system for the Great manual 22, Swell manual 20 and pedalboard 24 will now be described in detail. FIG. 7 illustrates the various inputs and outputs for great multiplexer and driver 26, wherein lines **28*a* carry the inversions of the K numbers referred to earlier. The circuitry in this and the subsequent figures is drawn in negative logic. Lines 456 are connected to lines 28*a* and two inverters 458 such that the signals on lines 28 are the noninverted K numbers. Multiplexer and driver 26 causes lines 28*a* to carry a logic 1 (negative voltage) in succession for a period of eight time frames each as the manuals 20, 22 and 24** are scanned.

Figure 8:
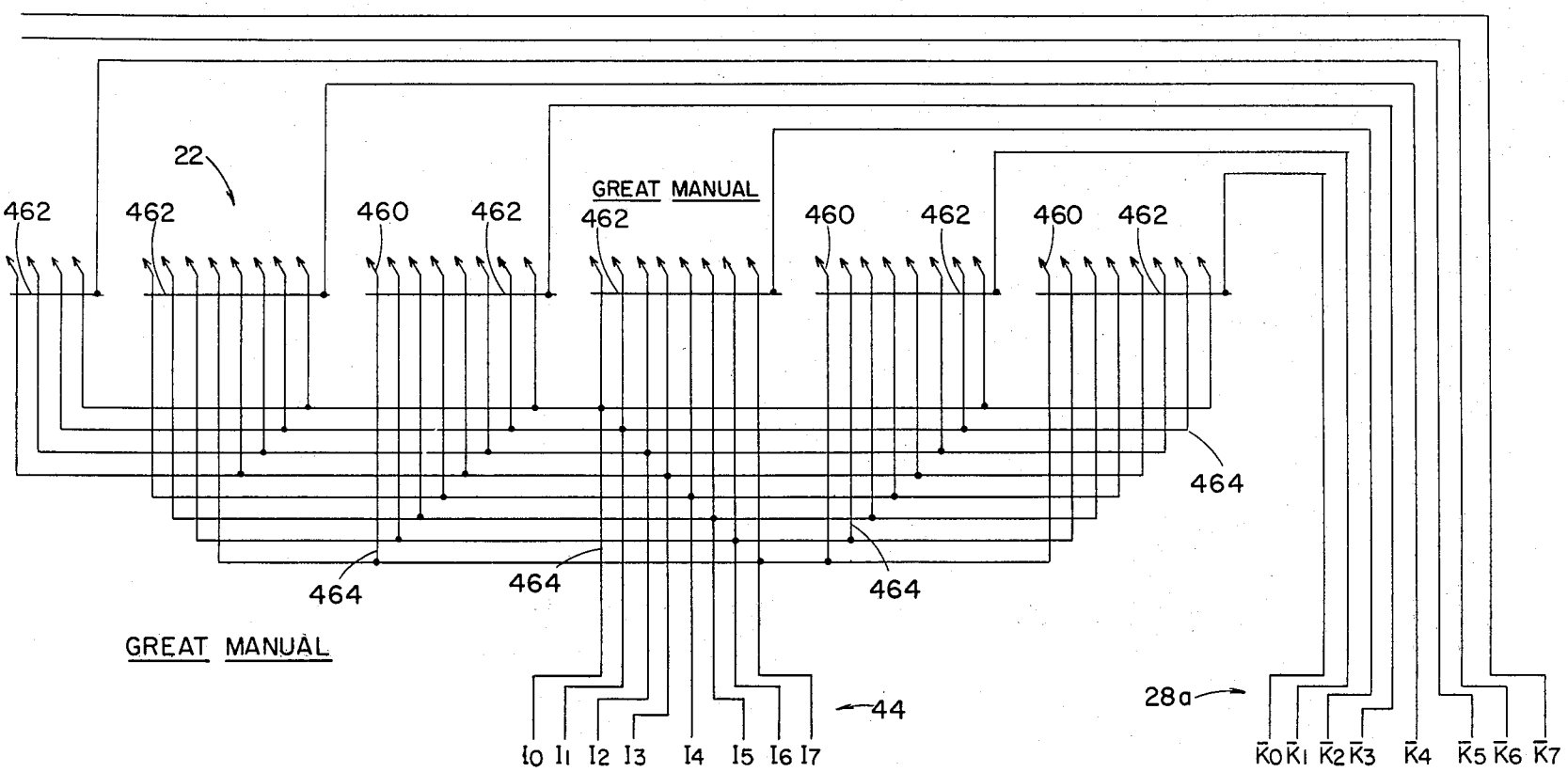
FIG. 8 is a schematic of the Great manual.

A portion of Great manual 22 is illustrated in FIG. 8 and it will be seen at the inverted K lines **28*a* are connected, respectively, to the buses or switch rails 462 associated with the eight groups of keyswitches 460. Thus, as lines 28*a* are sequentially activated, the associated bus 462 is also actuated thereby enabling the keyswitches 460 which come into contact with it depending on which keys of the manual 22** are depressed.

Lines 44, which carry the I numbers, are connected respectively to the line 464 connected to the respective keyswitch 460 in each of the eight groups. Multiplexer 26 (FIG. 7) enables lines 44 in sequence and repetitively in synchronism with the multiplex clock pulses on line 466 from multiplex clock 468. On each scan of manual 22, lines 44 are enabled in sequence eight times, but because buses 462 are enabled in sequence only once per scan of the manual 22, a particular keyswitch 460 is scanned only once per scan of the manual. Although only forty-four key-switches 460 have been illustrated, an institutional organ will typically comprise manuals of sixty-one keys each so that the I6 and I7 lines will also be connected to their respective buses (not shown).

Since each of the keyswitches 460 on Great manual 22 is scanned individually, a time division multiplexed data stream will be produced by multiplexer 26 on line 470 (FIG. 7). This data stream comprises a time slot for each of the keyswitches 460 wherein pulses appear in those time slots corresponding to depressed keys of the Great manual 22. At the end of each scan of manual 22, the K and I numbers are decoded internally in multiplexer 26 and a single pulse is produced on line 472. This pulse is known as the demultiplex latch pulse, and causes the serial data to be demultiplexed by the appropriate keyers 86, 98, 104, 92 and 148 (FIG. 1). The manner of decoding the multiplex drivers to generate a pulse of a particular time in the scan of the keyboard is well known in the art. Multiplexer 26 also generates a delta data pulse on line 48 each time there is a new key depressed on Great manual 22. Line 474 carries a reset pulse for purposes of system reset.

Figure 9:
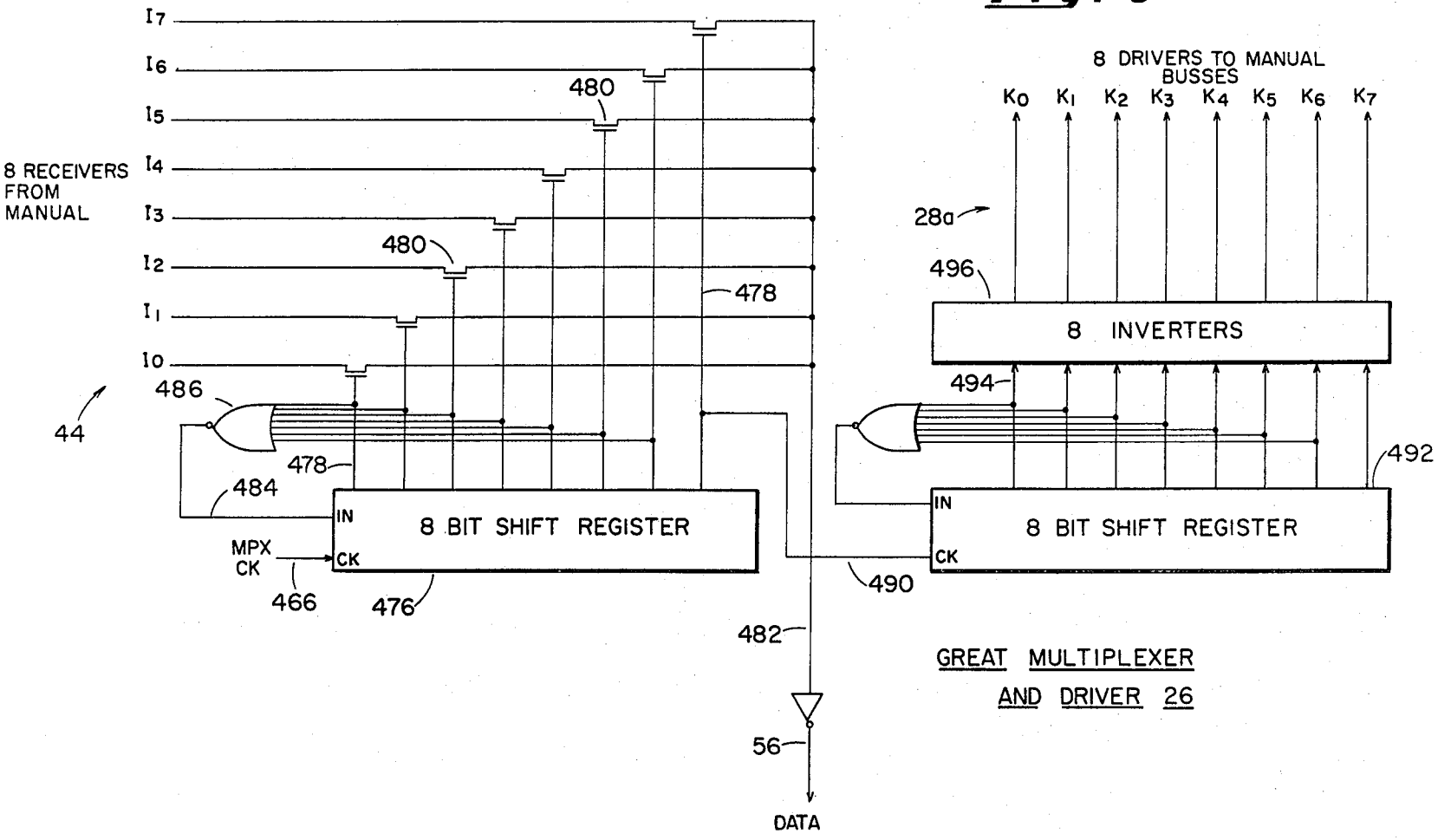
FIG. 9 is a schematic of the Great multiplexer and driver.

An exemplary circuit for generating the aforementioned K pulses and activating the I lines 44 is illustrated in FIG. 9. An eight bit shift register 476 is clocked by the multiplex clock train on line 466 and causes lines 478 to be activated in sequence from left to right as viewed in FIG. 9. Since lines 478 are connected to the gates of FETs 480, FETs 480 will be turned on in sequence thereby permitting lines 44 to be connected to data line 482 in sequence. Shift register 476 is connected as a recirculating shift register by virtue of lines 478 being connected to NOR gate 486.

On the eighth time frame of each cycle of shift register 476, a pulse will be generated on clock input line 490. The trailing edge of this pulse clocks eight bit shift register 492 thereby activating output lines 494 connected to the respective stages of shift register 492 in sequence. Lines 494 are held activated for eight clock pulses until the line 478 is deactivated. Output lines 494 are connected through inverters 496 to produce inverted K pulses on lines 28*a*.

Lines 28*a* are not only connected to Great manual 22, but are also connected to the buses (not shown) of pedalboard 24 and Swell manual 20. It should be noted, however, that pedalboard 24 generally comprises thirty-two pedals rather than sixty-one keys as in the case of Great manual 22 and Swell manual 20. Lines 28*a* are connected to Swell manual 20 and pedalboard 24 in the same manner as they are connected to Great manual 22, which is illustrated in FIG. 8.

Figure 10:
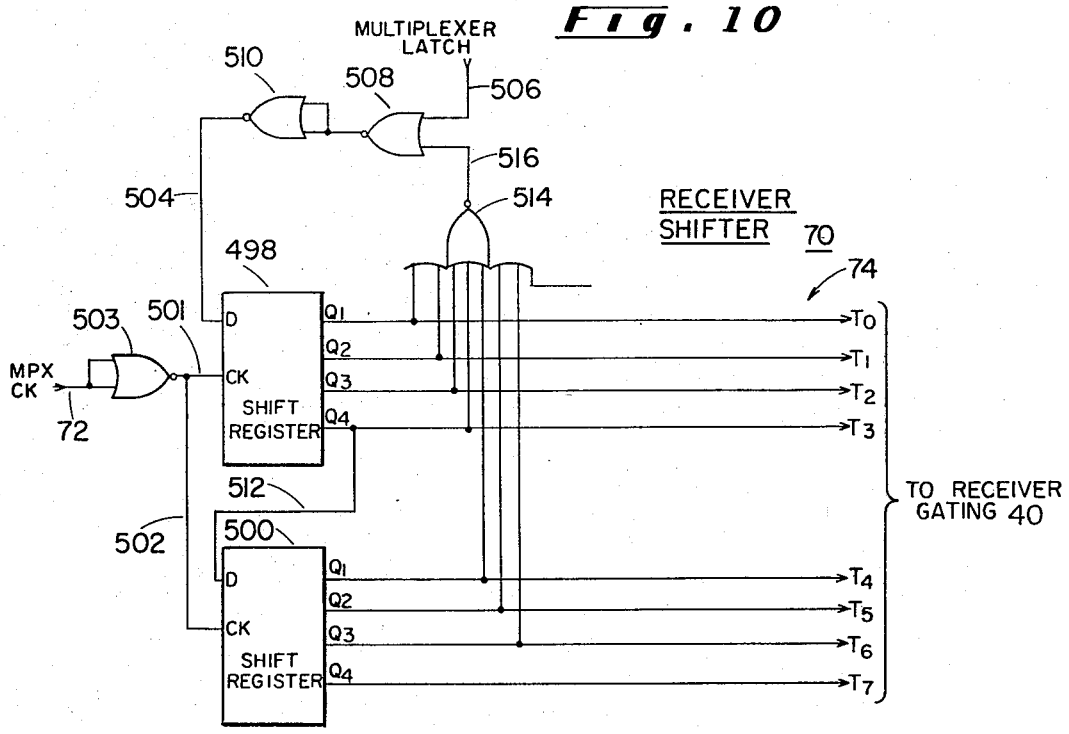
FIG. 10 is a schematic of the receiver shifter.

FIG. 10 shows receiver shifter 70, which produces the T numbers on lines 74 for multiplexing the Swell manual 20 and pedalboard 24 as well as provide timing for the remainder of the system in conjunction with the K pulses produced by multiplexer 26 (FIG. 7). The T0–T7 pulses produced on lines 74 are in synchronism with the I0–I7 activating pulses produced on the outputs 478 of the respective stages of shift register 476 (FIG. 9). They are produced by shift registers 498 and 500, which are clocked by the train of clock pulses on lines 501 and 502 from inverter 503. Inverter 503 is connected to multiplex clock line 72 (FIG. 7). Data is loaded into shift register 498 on line 504 as a direct result of the multiplex latch pulse on line 506, which is connected to line 472 from multiplexer 26 (FIG. 7). Line 506 is connected to one of the inputs of NOR gate 508, the output of which is inverted by inverter 510. As the pulse on the data input 504 of shift register 498 is shifted through it in synchronism with the multiplex clock pulses on line 501, the Q1, Q2, Q3 and Q4 outputs are sequentially activated. The Q4 output is connected to the data input of shift register 500 over line 512 so that the Q4 output pulse is then shifted through shift register 500 and sequentially activates the Q1–Q4 output lines thereof. The Q1–Q4 outputs of shift register 498 and the Q1–Q3 outputs of shift register 500 are connected to the inputs of NOR gate 514, the output 516 of which is connected to the other input of NOR gate 508. This arrangement causes shift registers 498 and 500 to function as a recirculating eight bit shift register. This activates the T0–T7 lines 74 in sequence encyclically each scan of manuals 20 and 24. As indicated earlier, the T pulses are in synchronism with the I pulses produced by multiplexer 26. The multiplex latch pulse on line 506 serves to keep shift registers 498 and 500 in synchronism with multiplexer 26.

Figure 11:
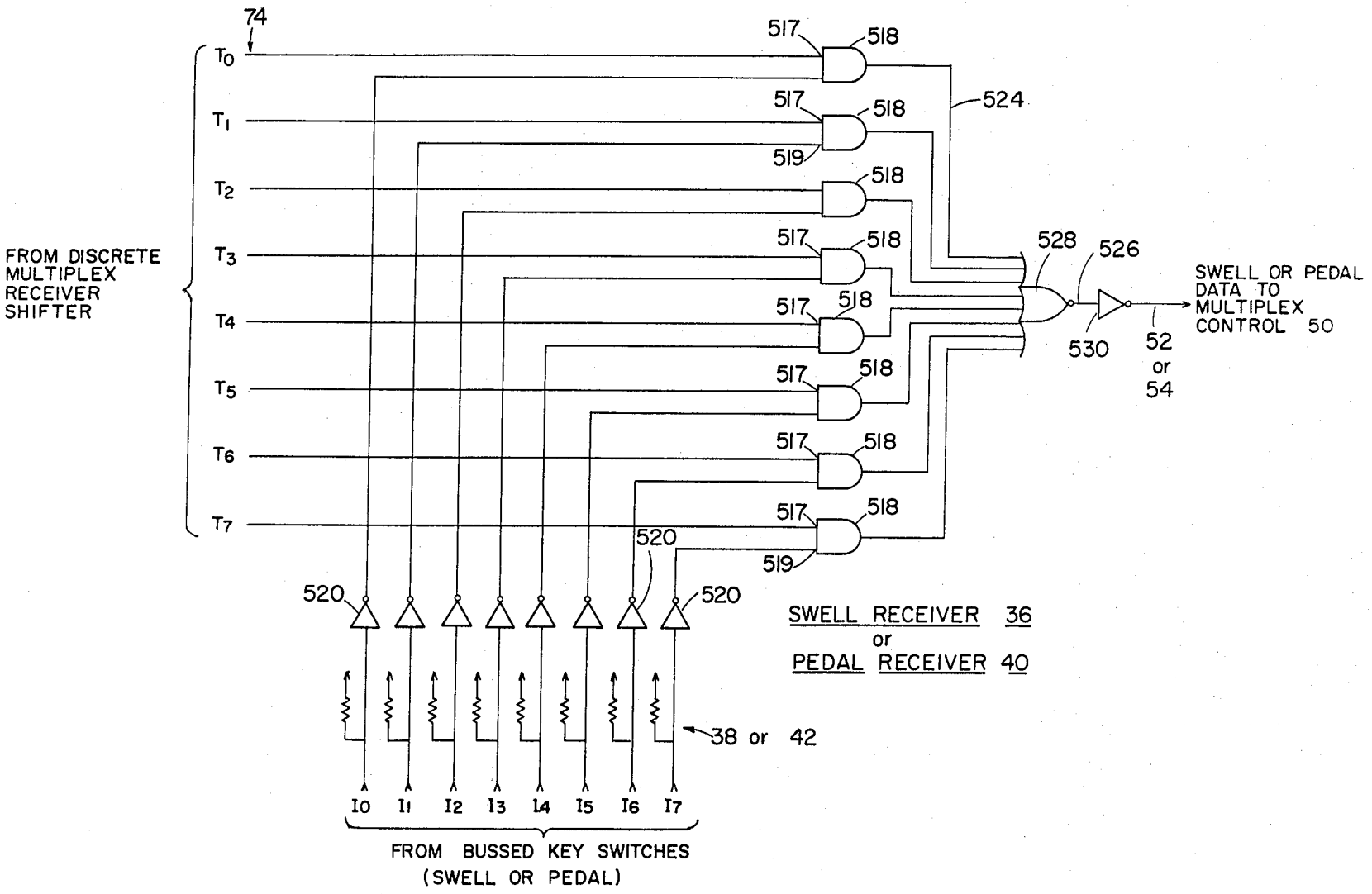
FIG. 11 is a schematic of the Swell or Pedal receiver.

FIG. 11 illustrates either swell receiver 36 or pedal receiver 40. Lines 74 to receiver shifter 70 shown in FIG. 10 are connected to one of the inputs 517 of the respective AND gates 518, and the other inputs 519 are connected to the outputs of inverters 520. Inverters 520 are connected to the I0–I7 lines 38 or 42 connected to the ganged keyswitches of either the Swell manual 20 or pedalboard 24. The receiver illustrated in FIG. 11 is identical for Swell manual 20 and pedalboard 24, and the manner in which lines 38 or 42 are connected to the keyswitches is similar to that illustrated in FIG. 8 in connection with Great manual 22.

The T pulses on lines 74 enable AND gates 518 in sequence so that one group or ganged keyswitches at a time is connected to the outputs 524 of AND gates 518. Since the K drive pulses from multiplexer 26, which appear on lines 28*a* (FIG. 7), activate the buses for the Swell manual 20 and pedalboard 24 in sequence and for eight time slots each, a time division multiplexed data stream appears on the output 526 of NOR gate 528. This output is inverted by inverter 530, and the serial data stream appears on lines 52 and 54 for the swell receiver 36 and pedal receiver 40, respectively. It should be noted that, because the T pulses from receiver shifter 70 (FIG. 10) are generated in synchronism with the I0–I7 enabling pulses of multiplexer 26 (FIG. 7), and because the K pulses generated by multiplexer 26 are common to manuals 20, 22 and 24, the serial data streams generated in parallel on lines 52, 54 and 56 (FIG. 1) are synchronized with each other.

Figure 12:
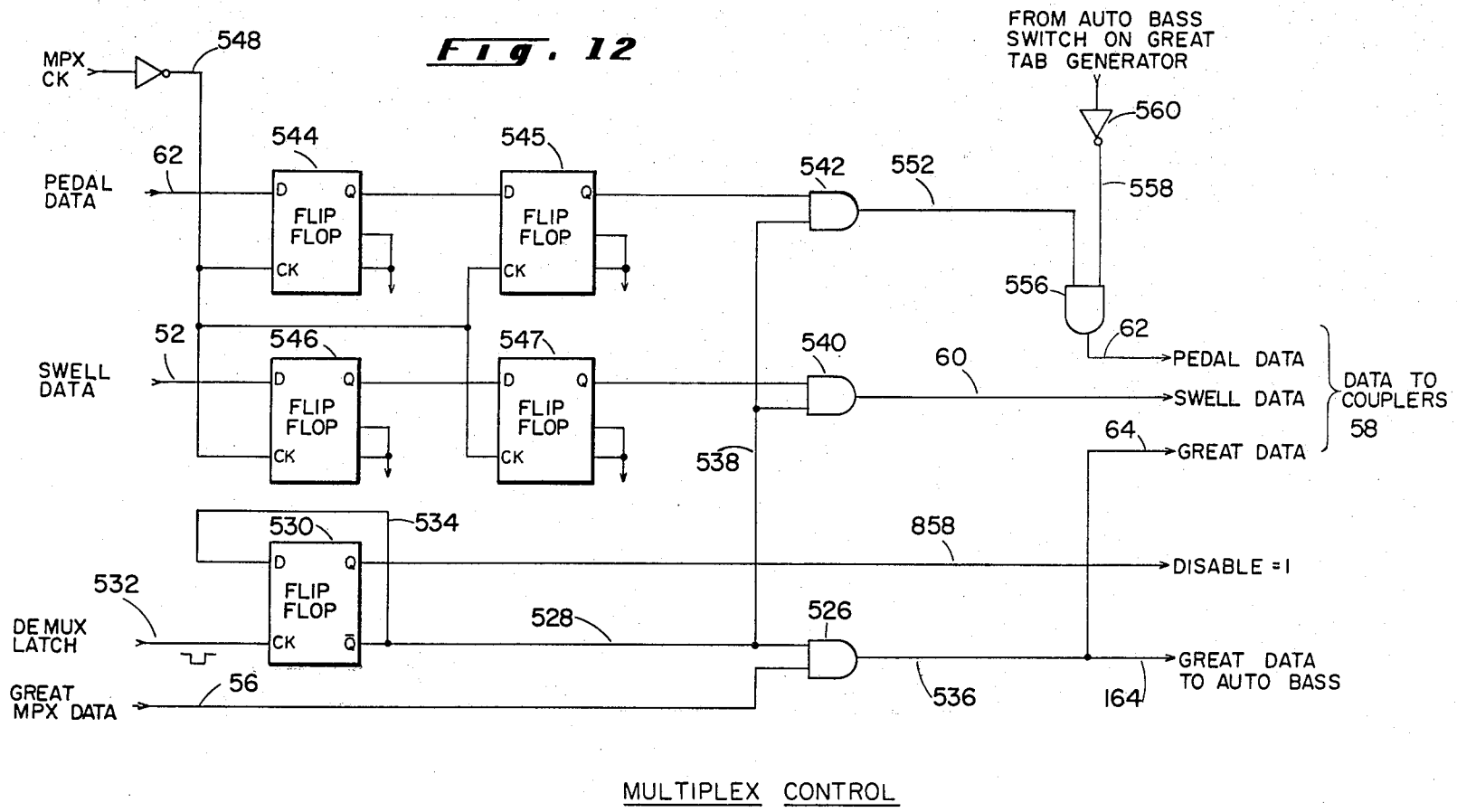
FIG. 12 is a schematic of the multiplex control block.

The serial data streams on lines 52, 54 and 56 are fed into multiplex control block, 50, which is illustrated in detail in FIG. 12. As mentioned earlier, the various footages selected by tabs 78 are achieved by delaying the pulses corresponding to depressed keys of the various keyboards by one or more octaves or by a portion of an octave. Accordingly, the actual data stream by the time it reaches keyers 86, 98, 104, 92 and 148, is considerably longer than the sixty-one time frames associated with manuals 20 and 22 and the thirty-two time frames associated with pedalboard 24. This means that the keyboards cannot be again scanned immediately and produce serial data because this data would overlap with the delayed pulses associated with the lower frequency footages.

The function of multiplex control block 50 is to provide data to couplers 58 and to the automatic bass circuit 160 (FIG. 1) on alternate scans of manuals 20, 22 and 24. This alternate scan technique greatly simplifies the timing and control of the multiplexing of the manuals and synchronization of the demultiplexing keyers 86, 98, 104, 92 and 148 with multiplexing of the manuals. Serial data from the Great manual multiplexer 26 on line 470 is connected to line 56 in FIG. 12, and this is connected to one of the inputs of AND gate 526. The other input of AND gate 526 is connected over line 528 to the $\overline{Q}$ output of D-type 4013 flip-flop 530. The clock input 532 of flip-flop 530 is connected to the demultiplex latch line 472 of multiplexer 26 so that flip-flop 530 is clocked once each scan of the Great manual. The $\overline{Q}$ output of flip-flop 530 is connected over line 534 to the D input thereof. Flip-flop 530 functions as a divide-by-two and enables AND gate 526 on alternate scans of Great manual 22. Thus, on the first scan thereof, the $\overline{Q}$ output of flip-flop 530 will enable AND gate 526, but when the demultiplex latch pulse is received on line 532 at the end of that scan, the $\overline{Q}$ output will change states thereby disabling AND gate 526. This has the effect of permitting Great multiplex data on line 56, although it is generated on each scan of Great manual 22, to be passed by AND gate 526 to output line 536 only on alternate scans. Line 528 is connected over line 538 to one input of each of AND gates 540 and 542 so that these AND gates are also enabled on the same alternate scans of the Swell manual 20 and the pedalboard 24, respectively.

The pedal serial data on line 62 is delayed two time slots by flip-flops 544 and 545, and the swell serial data on line 60 is delayed two time slots by flip-flops 546 and 547. Flip-flops 544–547 are clocked by the inverted multiplex clock train on line 548. The pedal data and Swell data is delayed simply for the purpose of causing it to be in synchronism with the Great data on line 56.

which is delayed by two time slots due to the internal configuration of multiplexer 26. On output lines 536, 60 and 552, then, the serial data from all three manuals is in perfect synchronism. Due to the action of AND gates 526, 540 and 542, data is present only on alternate scans of manuals 20, 22 and 24, although they are actually being scanned continuously, and serial data is being generated on every scan thereof. Data on line 164 from Great manual 22 is connected to the automatic bass circuit 160 over line 164, and to couplers 58 over line 64. Swell data is connected to couplers 58 over line 60, and the pedal data on line 552 is gated by AND gate 556 to line 62, which is connected to couplers 58. When the automatic bass tab is switched on, a control signal on line 558 from inverter 560 will disable AND gate 556 so that normal pedal data will be blocked. As will be described below, the pedal data is then produced by the lowest depressed key on the Great manual 22.

Figure 13:
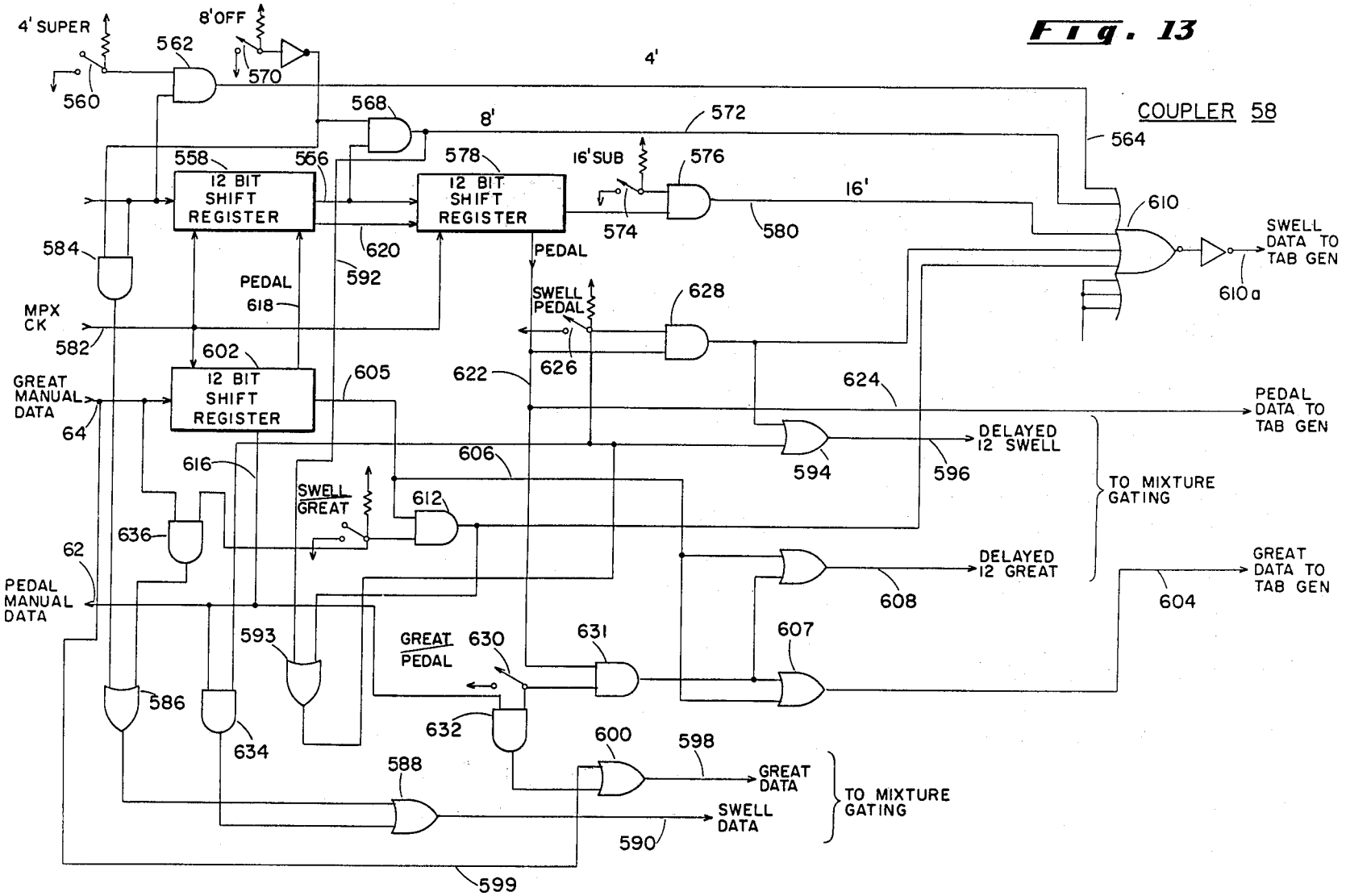
FIG. 13 is a schematic of the couplers.

With reference now to FIG. 13, the couplers 58 will be described. Basically, the function of an intermanual coupler is to route the data generated by one manual into the data stream corresponding to another manual. For example, if the Swell to Great tab is actuated, a depressed key on the Great manual will cause a tone corresponding to the depressed key of the Great manual and also a tone corresponding to the same key on the Swell manual, even though the latter key is not depressed. Similarly, the pedalboard can be coupled to the Great manual and to the Swell manual so that actuation of a pedal has the capability of producing tones corresponding to keys on the Great and Swell manual.

Another type of coupling is intramanual coupling wherein the actuation of a key in the eight foot range, for example, will also produce tones in the four foot range and/or sixteen foot range, and, in some organs, may even be coupled into the one foot or two foot range or down in frequency to the thirty-two foot range. In intramanual coupling, however, the coupling is confined to the manual itself, as opposed to intermanual coupling wherein one manual is coupled to the other.

As shown in FIG. 13, the Swell manual data is brought into couplers 58 over line 60 and the data corresponds to the four foot range of the Swell manual. If switch 560 is closed, AND gate 562 will be enabled and the swell data from line 60 will be passed by AND gate 562 onto the four foot output line 564. The serial data stream on line 60 is delayed twelve time slots by twelve bit shift register 558 so that the data stream on line 566 corresponds to the eight foot range, and this data is passed by AND gate 563 if it is enabled by the opening of switch 570. If switch 570 is closed, however, AND gate 568 will be disabled so that the eight foot data will not be passed. It will be recalled that the manuals are scanned from high to low so that the longer the serial data stream is delayed, the lower are the frequencies of the tones corresponding to the keydown pulses in the data stream. Lines 564 and 572 carry essentially the same data stream, except that the eight foot data stream on line 572 is delayed in time by twelve time slots, which corresponds to one octave.

In order to produce the sixteen foot tones, the sixteen foot Sub tab 574 is closed thereby enabling AND gate 576. The eight foot tones on line 566 are delayed by an additional twelve bits by shift register 578 so that the data stream appearing at the input of AND gate 576 and on its output line 580 is the same data stream that appeared at line 60, but has been delayed in time by twenty-four bits so that it corresponds to the sixteen foot range. Shift registers 558 and 578 are clocked by the multiplex clock train on line 582.

The four feet swell data is passed by AND gate 584 when this gate is enabled by opening switch 570. The data is passed by OR gate 586 and OR gate 588 to the swell data output line 590, which is connected to mixture generator 168. Output line 590 is one of the group of lines indicated generally as 172 in FIG. 1. The swell data at the output of AND gate 568 is carried by line 592 and OR gates 593 and 594 to the delayed swell output line 596, which is also connected to the mixture gating circuit (FIG. 17) forming a portion of mixture generator 168. It will be noted that the data appearing on line 596 is the original data on line 60 but delayed by one octave.

Great manual serial data is brought into coupler block 58 over line 64, and is connected to the Great data output line 598 over line 599 and OR gate 600. Line 598 is connected to the mixture gating circuit in mixture generator 168. The Great data stream passes through twelve bit shift register 602 thereby transforming it down into the eight foot range and is connected to the great data output line 604 by lines 605, 606 and OR gate 607. Line 608 carries the same data for connection to the mixture gating circuit.

The Great data stream at the output 605 of shift register 602 is coupled to the Swell manual collector NOR gate 610 by enabling AND gate 612. This is accomplished by closing the Swell to Great switch 614.

Pedal serial data is brought into coupler 58 over line 62, and is connected to pin 6 of the 4006 eighteen bit shift register 602 by line 616. Shift registers 558, 578 and 602 are eighteen bit shift registers, and since only twelve bits have previously been used for the Swell and Great data, the remaining capacity can be utilized to delay the pedal data without the necessity for using additional shift registers. The output at pin 8 of shift register 602, which is line 618, comprises the data on input line 616 delayed by four bits. This, in turn, is connected to pin 6 of shift register 558 and brought out on pin 8, which is connected to line 620, thereby delaying the pedal data an additional four bits, and line 620 is connected to pin 6 of shift register 578 and brought out on pin 8 to line 622, thereby delaying the pedal data an additional four bits. Thus, the data stream appearing on line 622 and on line 616 is the same data stream on the pedal input 62, but delayed twelve bits, or one octave.

Figure 17:
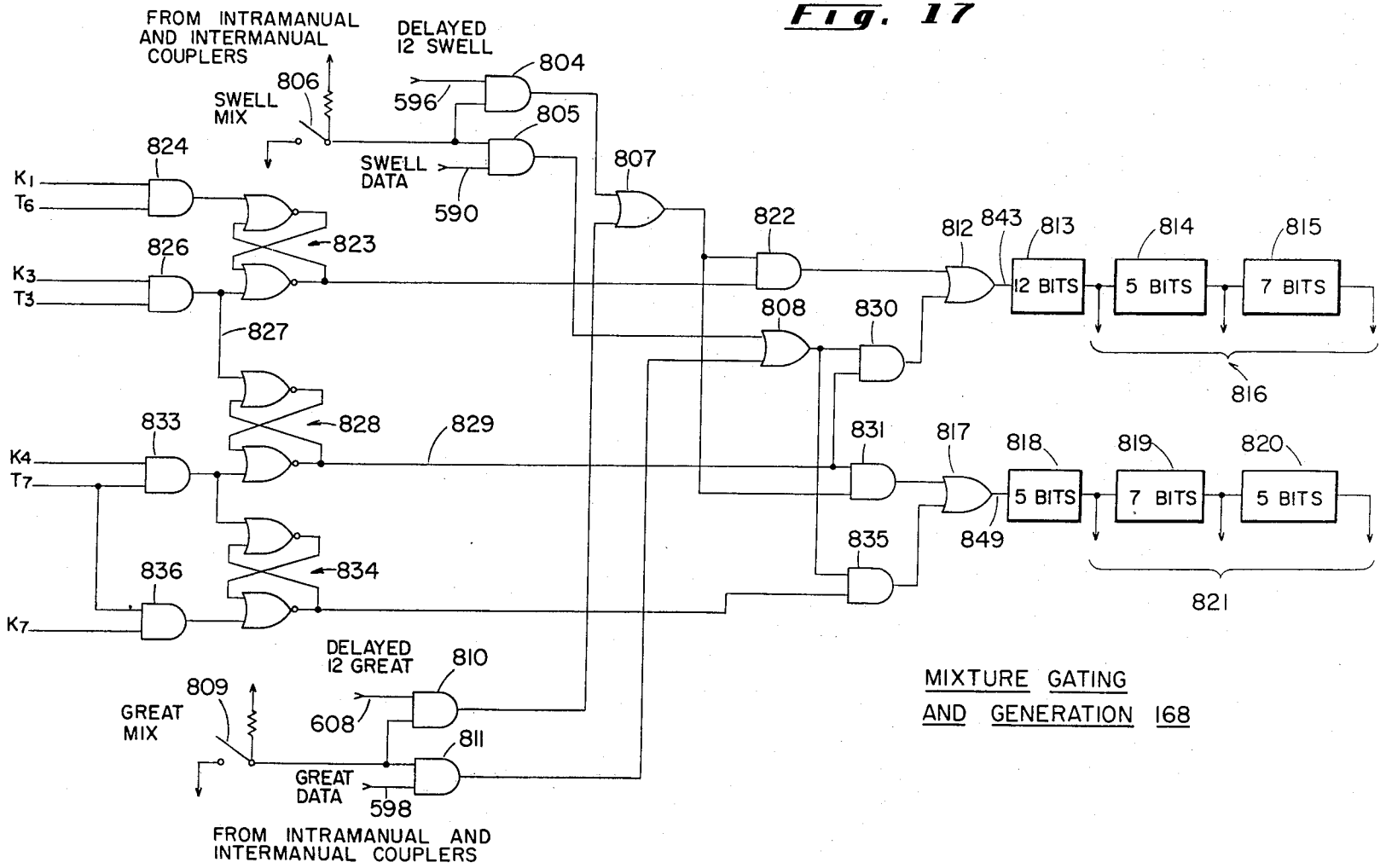
FIG. 17 is a schematic of the mixture gating and generation circuit.

By closing the Swell to Pedal tab switch 626, the pedal data on line 622 will be coupled by AND gate 628 to one of the inputs of Swell NOR gate 610. Similarly, by closing the Great to Pedal tab 630, AND gate 631 will be enabled thereby passing the pedal data through OR gate 607 to the Great data output line 604. This also enables AND gate 632 so that the pedal data from line 62 will be passed through OR gate 600 to the Great data output line 598 connected to the mixture gating circuit (FIG. 17). Pedal data is connected to the mixture gating swell data line 590 through OR gate 588 and AND gate 634, when the latter is enabled by closing the pedal to swell switch 626. Switch 614 also enables AND gate 636 so that the Great manual data on line 64 can be coupled to the Swell data output line 590 which is connected to the mixture gating circuit.

Tab generators 76, 120, 128, and 138 receive data either directly to indirectly from the couplers in the form of serial data streams wherein keydown pulses appear in time slots corresponding to the depressed keys of the respective manuals 20, 22 and 24 as well as keydown signals coupled from one manual to another or from one footage to another within a manual. Basically, the tab generators generate the appropriate footages by delaying the incoming data in increments of twelve bits for the octavely related footages, such as four foot, two foot, eight foot and sixteen foot, and by less than twelve bits for the mutations, such as two and two-thirds. In all cases, the incoming data is considered to be nominally in the one foot range so that if it is delayed by five counts it would then be in the one and three-fifths range, if delayed by twelve counts in the two foot range, etc. The incoming data streams are selectively delayed by using shift registers to produce the various footages that are recombined before being connected to the multiplexers/keyers.

Figure 14:
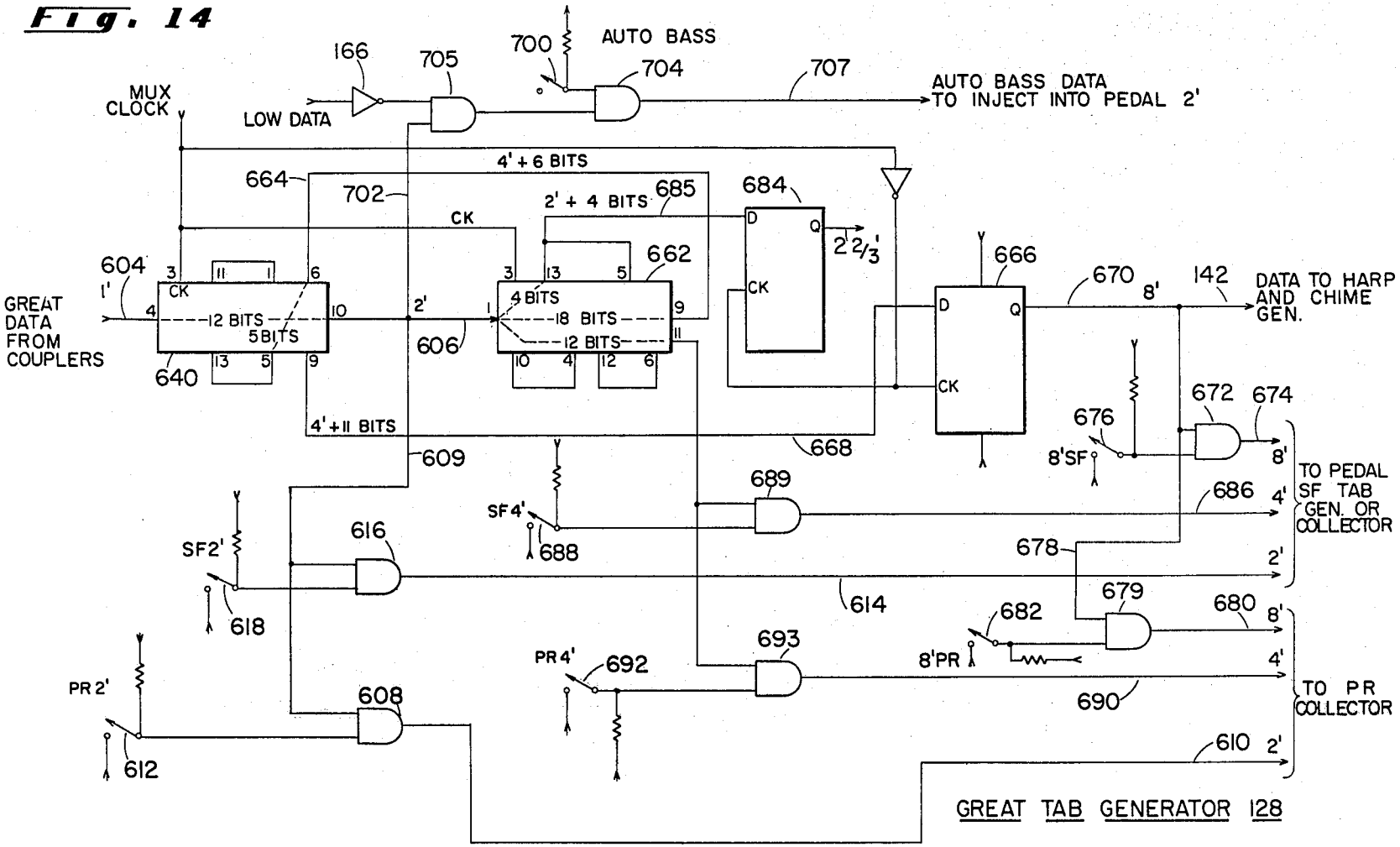
FIG. 14 is a schematic of the Great tab generator.

For purposes of illustration, only the Great tab generator 128 will be described in detail, although the Swell tab generator 76 and pedal tab generator 120 used basically the same technique for producing the desired footages. Referring now to FIG. 14, which illustrates the Great tab generator 128, the incoming serial data from coupler block 58 on line 604 is delayed twelve bits (one octave) by 4006 shift register 640 to produce at pin 10 on line 606 the two foot Great data stream. The two foot data stream is connected to one of the inputs of AND gate 608 by line 609, and appears on output line 610 if AND gate 608 is enabled by closing the two foot principal tab switch 612. Similarly, this data stream appears on the two foot stopped flute output line 614 if AND gate 616 is enabled by closing the stopped flute two foot tab switch 618.

The two foot input 606 to type 4006 shift register 662 is brought out on pin 9 after being delayed eighteen bits and connected to pin 6 of shift register 640 over line 664. From here it is brought out on pin 9 of shift register 640 after being delayed an additional five bits and is fed to the data input of D-type flip-flop 666 over line 668. Flip-flop 666 delays the data stream an additional one bit so as to produce the eight foot Great tab data stream on line 670. This is connected to line 142 for connection to the chiff, harp and chime tab generator 138 (FIG. 1) and through AND gate 672 to line 674 when the eight foot tab switch 676 is closed. Line 674 is connected to the stopped flute collector. The eight foot Great data on line 678 is passed by AND gate 679 to the eight foot principal collector line 680 when tab switch 682 is closed.

If desired, the two and two-thirds mutation can be generated by connecting pin 13 of shift register 662 to the data input of flip-flop 684 over line 685. This produces an additional delay of five bits to produce the desired mutation.

The four foot stopped flute data stream on line 686 is produced by closing switch 688 thereby enabling AND gate 689 and permitting the twelve bit delayed from pin 11 of shift register 662 to be passed to line 686. This same data stream will appear on the four foot principal output line 690 by closing switch 692 thereby enabling AND gate 693.

Great tab generator 128 produces on its output lines the stopped flute and principal two foot, four foot, and eight foot data streams, which are essentially the identical data streams but delayed in time depending upon the footage. The eight foot Great data on line 670 is connected to the harp, chiff and chime tab generator 138 over line 142.

When the automatic bass switch 700 is closed, the two foot Great data on line 702 is passed by AND gate 704 to the pedal two foot tab generator 120. The low bit is passed by AND gate 705 when it is enabled by the inverted low data control bit on input 166. In the automatic bass mode, the pedalboard 24 is disabled and the bass note is that which corresponds to the lowest key depressed in the lower two octaves of the Great manual. When the control bit on input 166 signals that this is, in fact, the lowest bit in the Great manual data stream, AND gate 705 is temporarily enabled thereby passing the lowest bit to AND gate 704, which will pass it on to output line 707 if the automatic bass switch 700 is closed. The lowest bit on line 707 is processed by the pedal tab generator 120. In pedal tab generator 120, the automatic bass data is selectively delayed by means of shift registers to produce the one foot, one and one-third foot, two foot, four foot, eight foot or sixteen data streams, which are collected together and connected over lines 124 and 126 to the inputs of multiplexer/keyers 98 and 104. The footage generation techniques utilized in the pedal tab generator 120 are essentially the same as those utilized in the Great tab generator 128, which is illustrated in FIG. 14.

Figure 15:
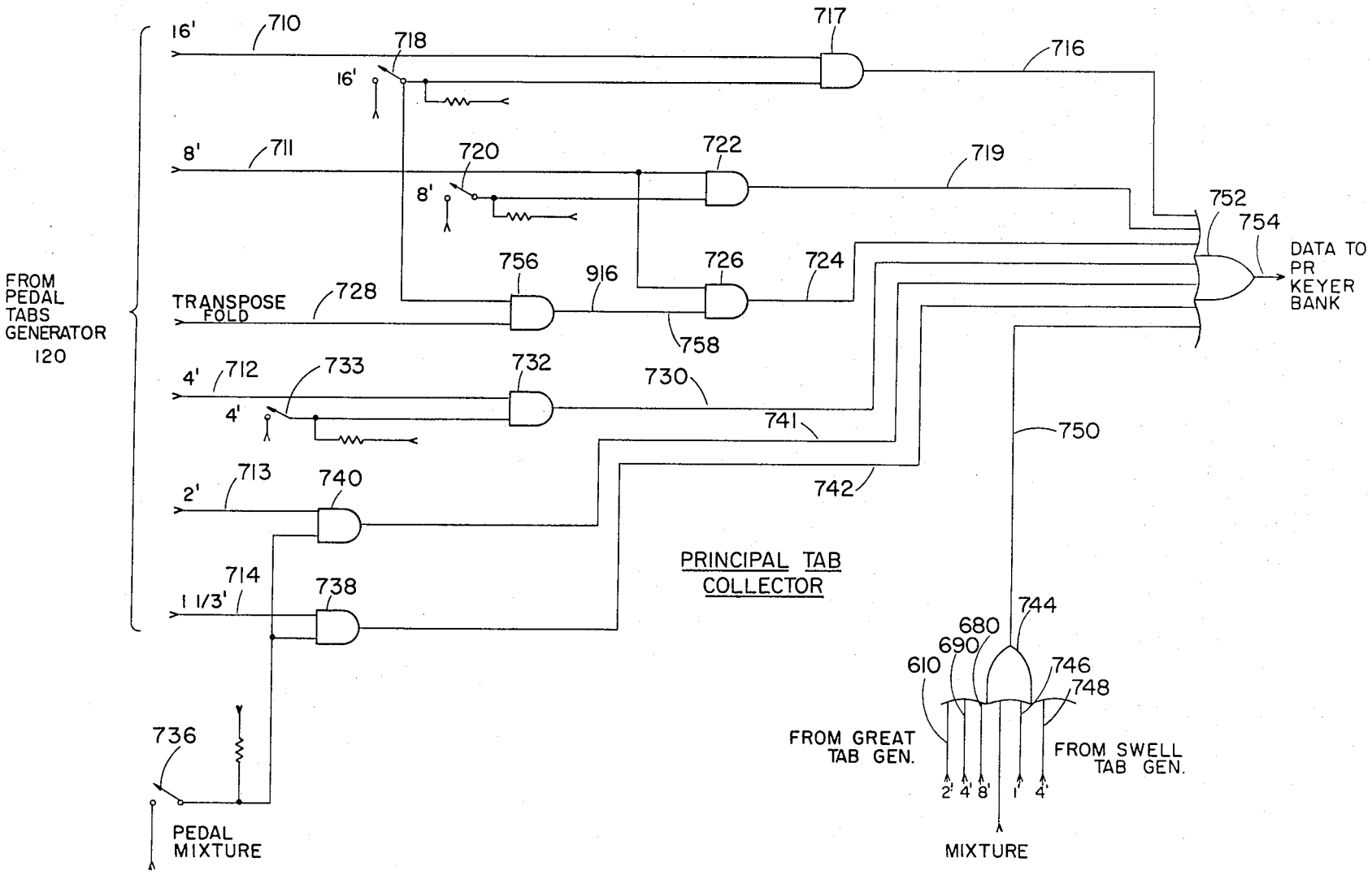
FIG. 15 is a schematic of the Principal tab collector.

FIG. 15 illustrates the principal tab collector for the serial data streams received from the Swell tab generator 76, pedal tab generator 20 and Great tab generator 128. Line 710 carries the sixteen foot pedal data, which is the two foot data on line 24 of coupler 58 (FIG. 13) that has been delayed by forty-eight bits (four octaves). This is passed to output line 716 when AND gate 717 is enabled by closing the sixteen foot tab switch 718. The eight foot pedal data on line 711 is connected to output line 719 by closing the eight foot switch 720, which enables AND gate 722, and is connected to output line 724 by AND gate 726, which is enabled by closing switch 718 and the appropriate control signal on the transpose fold line 728.

Four foot pedal data on line 712 is connected to output line 730 by enabling AND gate 732, which is accomplished by closing switch 733. The closing of pedal mixture switch 736 enables AND gates 738 and 740, thereby passing the two foot and one and one-third foot data streams on lines 713 and 714 to output lines 741 and 742.

The two foot output line 610, the four foot output line 690 and the eight foot output line 680 from Great tab generator 128 (FIG. 14) are connected to three of the inputs of OR gate 744. Also connected thereto are the output lines 746 and 748 for the two foot and four foot data streams, respectively, from Swell tab generator 76 (FIG. 1). OR gate 744 collects these data streams and produces a single data stream on line 750, which is one of the inputs of OR gate 752. The other inputs of OR gate 752 are lines 715, 719, 724, 730, 741 and 742, which carry the pedal tab data streams. OR gate 752 collects these data streams and produces a single principal data stream on line 754, which is connected to the appropriate input of the principal keyer/demultiplexer bank 104 (FIG. 1). A keyer bank of this type is illustrated in detail in FIGS. 2-6. Although not illustrated in a separate block in FIG. 1, the collector of FIG. 15 is essentially a portion of the principal keyer/multiplexer bank 104. A somewhat similar collector circuit is part of the flute keyer/multiplexer bank 98.

Line 142 from Great tab generator 128 (FIG. 14) connects to the input of the chiff, harp and chime generator block 138. Harp data is produced by shifting the Great data on line 142 such that it is in the four foot range, and this is fed to demultiplex percussion block 46 over line 144. Chime data is produced by delaying the highest note in the data stream on line 142 in three shift registers such that notes five bits, twelve bits and twenty bits lower than the note played are produced in parallel. For example, if C is played, G in the octave below it, C an octave lower, and E below that will be played. A similar technique is disclosed in allowed patent application Ser. No. 000,158, filed Jan. 2, 1979, which application is expressly incorporated herein by reference. This chime data is fed to multiplex percussion block 46 over line 144.

Chiff is played together with the eight foot tab from the Great manual 22, and this is two and two-thirds away from the eight foot data pulse. The chiff data is also fed to multiplex percussion block 46. If desired, the chiff, harp and chime data can be prioritized so that if the chime tab is actuated, harp and chiff will not play, if the harp tab is actuated chiff will not play, thereby assigning chiff the lowest priority.

Figure 16:
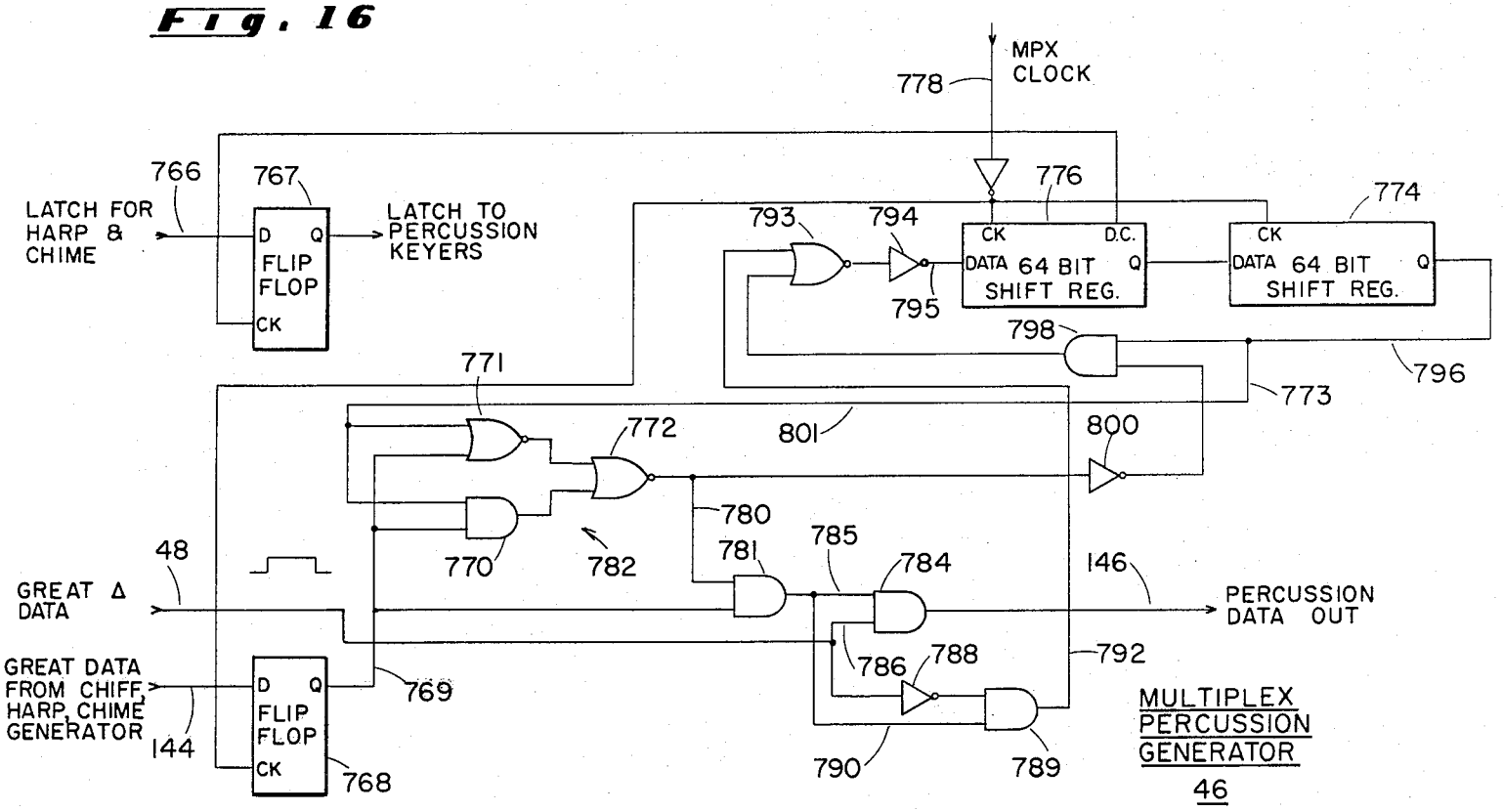
FIG. 16 is a schematic of the multiplex percussion generator.

Multiplex percussion circuit 46 is illustrated in detail in FIG. 16, and functions to produce a burst of data to simulate the percussive nature of the harp, chime and chiff sounds. The latch command from Great multiplexer 26 is brought into the multiplex percussion generator 46 on line 766 to the data input of flip-flop 767, which delays the latch pulse by one clock cycle. The delta data pulse from great multiplexer 26 is brought in on line 48, and this pulse is typically ten milliseconds wide. The data stream from chiff, harp and chime generator 138 on line 144 is connected to the data input of flip-flop 768, and this delays the data stream by one clock cycle. Since both the latch command and the data stream are delayed by the same amount, the percussion keyers 148 are not affected. The purpose of the delay is to eliminate the effect of minute delays which are caused upstream from the system.

The data stream on the Q output line 769 of flip-flop 768 is connected to one of the inputs of AND gate 770 and one of the inputs of NOR gate 771. The outputs of gate 770 and 771 are connected to the inputs of NOR gate 772, and these three gates function as an exclusive OR circuit. Line 773 is connected to the Q output of sixty-four bit shift register 774, and is connected to the other inputs of AND gate 770 and NOR gate 771. Sixty-four bit shift register 774 and sixty-four bit shift register 776 are connected in series and are clocked by the multiplex clock train on line 778. Shift register 776 and 774 together form a one hundred twenty-eight bit storage shift register, which is exactly the length of two scans of great manual 22.

The output of NOR gate 772 is connected over line 780 to one of the inputs of AND gate 781, the other input of which is connected to line 48. AND gate 781 enables the serial data from the Q output of flip-flop 768 if it is enabled by the output of exclusive OR arrangement 782. This occurs only when the serial data on lines 769 is different from the serial data which is being recirculated by shift registers 776 and 774. The necessity for this arises because of the fact that the delta data pulse, which is much wider than a single clock cycle, is produced each time a new key is depressed. The purpose of percussion generator 46 is to produce a burst of data for each new key which is depressed and produce this burst for the width of the delta data pulse. If an earlier depressed key is still being held when a new key is depressed, and if data for both of these keys is outputed to the keyers 148, the first depressed key would sound again. In order to prevent this, incoming new data from the Q output of flip-flop 763 is compared with recirculating data in shift register 776 and 774, which data is representative of all keys presently depressed at any time, so that the new data is separated out for transmission to the keyers 148.

AND gate 784 is connected to the output of AND gate 781 by line 785, and has its other input 786 connected to delta data line 48. Thus, AND gate 784 is enabled only during the ten millisecond delta data pulse, and all new data passed by AND gate 781 will be passed to output line 146 on each alternate scan of the great manual 22. This, in effect, produces a burst of new data which, when it is utilized to control the sustain type keyers 148 described earlier, produces a percussive effect.

The delta data pulse on line 48 is inverted by inverter 788 so as to disable AND gate 789, which gate is connected to receive the serial data from the output of AND gate 781 by line 790. At the end of the delta data pulse, however, AND gate 789 is then enabled to pass the delta stream from AND gate 781 over line 792 to the input of NOR gate 793. The output of NOR gate 793 is inverted by inverter 794 and fed to the data input 795 of shift register 776. This arrangement loads the new data into shift register 776 and 774 for recirculation. It will be noted that the Q output 796 of shift register 774, after being gated by AND gate 798, is also connected to the input of NOR gate 793 for recirculation of the data already in shift registers 776 and 774.

Recirculation of the data in shift registers 776 and 774 is accomplished by AND gate 798, which, due to the presence of inverter 800, is enabled each time there is a match between the new data from flip-flop 768 and the output data from shift register 774 on line 801. Thus, exclusive OR arrangement 782 enables AND gate 798 for recirculation whenever there is a match between the data, and enables AND gate 781 for the gating of new data whenever there is no match between such data and the recirculated data. A new data burst will be produced for each new key which is depressed, and the sustaintype keyers 148 will cause the sound to decay out with a percussive envelope independently of the length of time the keys are held down.

The mixture generator 168 will now be described, with reference to FIG. 17. Swell data from coupler 58 (FIG. 13) is brought into the mixture gating and generation block 168 over line 590, and the same data which has been delayed by twelve bits (one octave) is brought in on line 596. Similarly, the Great data stream from coupler 58 is brought into circuit 168 on line 598, and the same data which is delayed by one octave is brought in on line 608. AND gates 804 and 805 are enabled when the Swell mixture tab 806 is closed, thereby gating the delayed Swell data to OR gate 807 and the normal Swell data to OR gate 808. When Great mixture tab 809 is closed, AND gate 810 and 811 are enabled thereby passing the delayed Great data to OR gate 807 and the normal Great data to OR gate 808.

As mentioned, earlier, it is customary to produce mixtures in different inversions depending on the octave in which the key or keys are depressed. For the top octave extending between high C and the C below high C, the unison (the depressed key) forms the outside notes and mutations (two and two-thirds, for example) forms the inner note. Assuming the depressed key to be nominally in the one-half foot range, the lower unison is in the four foot range, the upper unison is in the two foot range, and the mutation is two and two-thirds foot.

For the next lower octave extending from B to the next lower C, the unison forms the inner note and the mutations the outside note. Thus, the inner note is at two foot, the upper mutation is at one and one-third foot, and the lower mutation is at two and two-thirds foot. In this case, assuming that a C key is depressed, G, C, and G notes will be produced, in that order.

For the next octave extending from the next lower B to the C below it, the unisons again form the outside notes and the mutation the inside note. The footages for the unisons are one foot and two foot, and for the mutation one and one-third foot. For the lowest two octaves, the unison forms the inner note and the mutations the outside note, wherein the unison is at one foot and the mutations at one and one-third foot and two-thirds foot, respectively.

The data streams for the upper octave and for the third octave are routed to the inputs of OR gate 812, the output of which connects to three serially arranged shift registers 813, 814 and 815, which introduce delays of twelve bits, five bits and seven bits, respectively. The outputs 816 from shift registers 813, 814 and 815 form the unison and mutation data streams for these octaves. In a similar fashion, the Swell and Great data streams for the second highest octave and for the lowest two octaves are connected to the inputs of OR gate 817, the output of which is connected to three serially connected shift registers 818, 812 and 820, which introduce delays of five bits, seven bits and five bits, respectively. The outputs 821 of shift registers 818, 819 and 820 carry the unison and mutation data streams, and, like outputs 816, are collected and connected to the principal tab collector (FIG. 15).

If the depressed key is in the uppermost thirteen notes of the Swell or Great manual, it is necessary to delay the data stream, which is nominally in the one-half foot range, by twenty-four bits to produce the two foot data stream, and then delay this data stream by an additional five bits to produce the two and two-thirds foot data stream, and then delay this data stream by an additional seven bits to produce the four foot data stream. This can be accomplished by routing the delayed Swell data stream and delayed Great data stream on the outputs of AND gates 804 and 810, respectively, through AND gate 822. Because the data stream has already been delayed by a full octave (twelve bits) in the coupler block 58, shift register 813 will produce the additional twelve bits of delay for a total of twenty-four bits thereby producing the two foot data stream. Shift register 814 will delay this by an additional five bits to produce the two and two-thirds foot data stream, and shift register 815 will delay it an additional seven bits for the four foot data stream. AND gate 822 is enabled when RS flip-flop 823 is in its set position, and flip-flop 823 is set by the output of AND gate 824, which occurs at time K1, T6. At this time, the K1 line of multiplexer 26 (FIG. 7) is enabled, and the T6 line of receiver shifter 70 (FIG. 10) is enabled. Due to the fact that the data on line 596 is delayed two counts in the multiplexer and then by one octave, AND gate 822 will not be enabled until the fifteenth multiplexer count.

On the multiplexer count corresponding to the twenty-sixth note, which is K3, T3, AND gate 826 will reset RS flip-flop 823 and, because of the logic 1 on line 327, will set RS flip-flop 828. The output line 829 from RS flip-flop 828 is connected to the inputs of AND gates 830 and 831, and enables both of these AND gates simultaneously. The output of OR gate 808 carries the undelayed Swell and Great data and is connected to the other input of AND gate 830. Similarly, the output of OR gate 807 carries the delayed Swell and Great data and is connected to the other input of AND gate 831. At the same time, the undelayed swell and great data are passed by AND gate 830, and this corresponds to the third octave of keys.

The output of AND gate 831 is gated by OR gate 817 to shift registers 818, 819 and 820, which delay the data stream by five bits, seven bits and five bits, respectively. Because the data stream was initially delayed by twelve bits, however, the effect of shift register 818 is to delay it seventeen bits, thereby producing the one and one-third, two foot and two and two-thirds foot data streams for the mutation-unison-mutation notes.

Shift registers 813, 814 and 815 delay the data stream corresponding to the third octave by twelve bits, five bits and seventeen bits. This produces the one foot, one and one-third foot and two foot data streams corresponding to the unison-mutation-unison notes.

At count K4 T7, which corresponds to the thirty-seventh key, AND gate 833 is enabled thereby resetting flip-flop 828 and setting RS flip-flop 834. This enables AND gate 835, which gates the undelayed Swell and Great data corresponding to the lower two octaves of the manual through OR gate 817 into shift registers 818, 819 and 820. These shift registers delay the data by five bits, seven bits and five bits, respectively, thereby producing the two-thirds foot, one foot and one and one-third foot data streams. These, in turn, correspond to the mutation-unison-mutation notes of the lower two octaves. AND gate 835 is enabled until count T7 K7 whereupon AND gate 836 resets flip-flop 834 and no further data is passed by AND gate 835.

Figure 18:
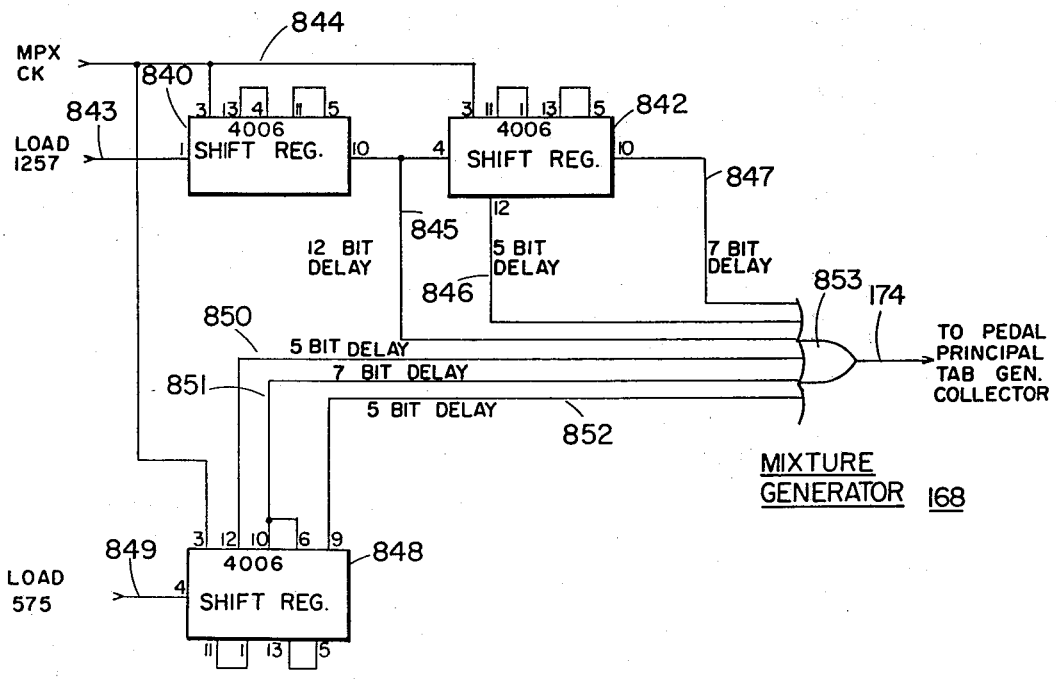
FIG. 18 is a schematic of the mixture generator.

FIG. 18 illustrates a preferred shift register arrangement for providing the necessary delay to generate the mixture data streams. Shift registers 840 and 842 are substituted for shift registers 813, 814 and 815 in FIG. 17, and are connected to the output 843 of OR gate 812. Shift registers 840 and 842 are type 4006 shift registers that are clocked by the multiplex clock train on line 844 and produce twelve bit, five bit and seven bit delays on output lines 845, 846 and 847, respectively. Type 4006 shift register 848 takes the place of shift registers 818, 819 and 820 in FIG. 17, and is connected to the output line 849 from OR gate 817. Shift register 848 produces the required five bit, seven bit and five bit delays on output lines 850, 851 and 852. The outputs of shift registers 840, 842 and 848 are collected together by OR gate 853 the output line 174 of which is connected to the principal keyer/multiplexer bank 104.

Figure 19:
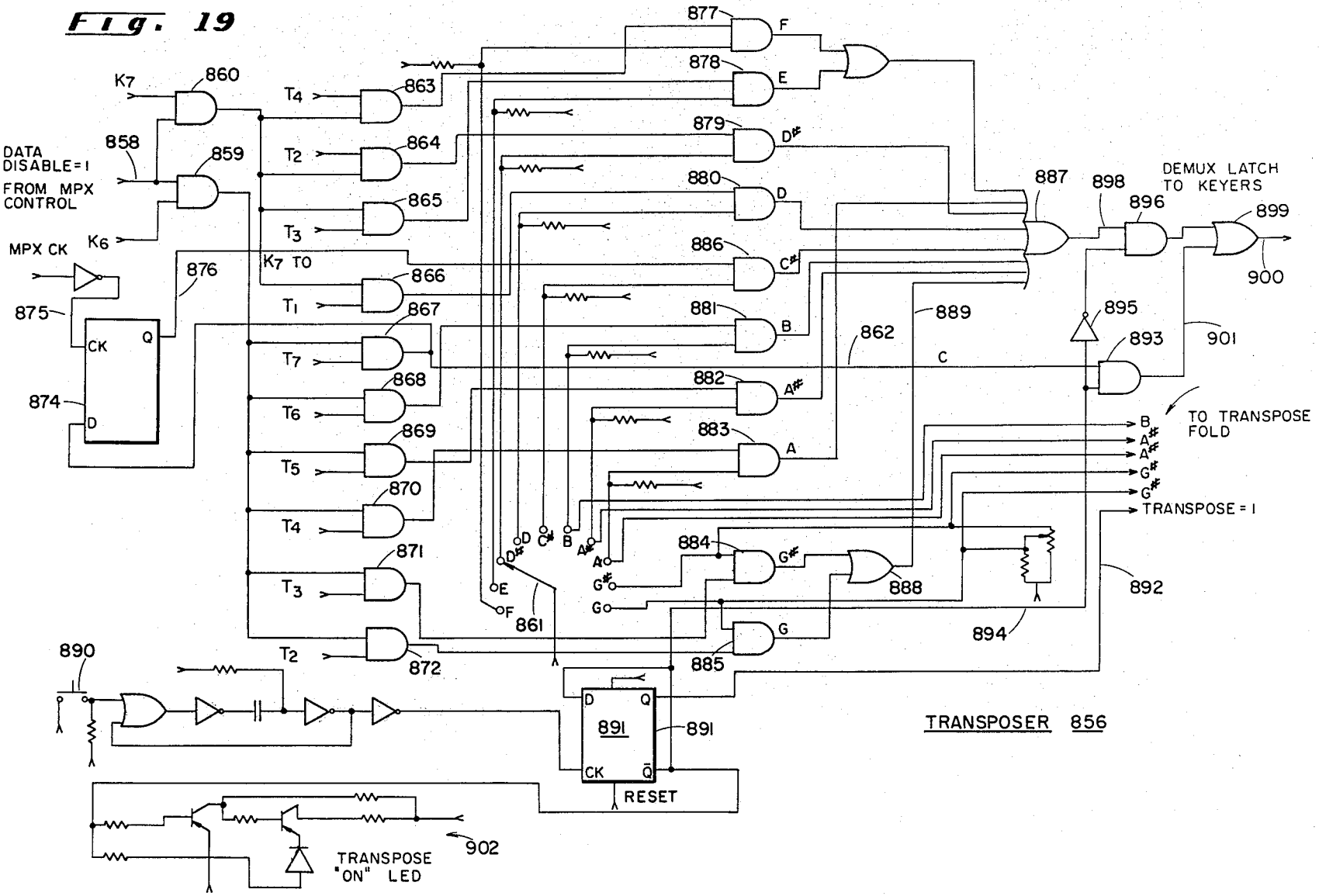
FIG. 19 is a schematic of the transposer.

With reference now to FIG. 19, the transposer block 856, which is illustrated generally in FIG. 1A, will be described in detail. The transposer enables the data to be changed automatically to a different pitch by altering the time at which the latch pulse is transmitted to the keyer/multiplexers 86, 98, 104, 92 and 148. In the past, it has generally been the practice to delay the data stream to accomplish transposition, but this has often necessitated a very long shift register in the case where wraparound of the data occurs. For example, if the lowest note on the organ is transposed lower in frequency, it would be necessary to delay the pulse corresponding to this note by an entire scan of the keyboard so that it would appear in its proper transposed position in the octave above the lowest octave of the organ.

In FIG. 19, the data disable pulse is brought in on line 858, which connects to the Q output of flip-flop 530 in the multiplex control block 50 illustrated in detail in FIG. 12. It will be recalled that data is passed only during alternate scans of the manuals, and when flip-flop 530 activates line 858, AND gates 859 and 860 in FIG. 19 will be enabled to pass the K7 and K6 lines from great multiplexer 26 (FIG. 7).

If no transposition is selected by player operated selector switch 861, which corresponds to C, AND gate 867, which has as its inputs the K6 T7 lines, will produce on line 862 a pulse at time K6 T7, which is the normal time frame in which the demultiplex latch pulse should be produced. The data stream will arrive at the keyer/demultiplexers 86, 98, 104, 92 and 148 at the normal time so that the data produced by depression of the keys of the manuals will correspond to the note names of those keys.

AND gates 863, 864, 865, 866, 868, 869, 870, 871 and 872 are connected to various combinations of the T and K lines as illustrated in FIG. 19 so that they will be enabled at times earlier or later than the K6 T7 time. For example, AND gate 868 will be enabled at K6 T6, which is a time one time frame earlier than the normal latch time frame of K6 T7, and has the effect of causing the data stream to advance one less time frame further in the keyers. This transposes the entire data stream by one-half step lower in frequency. Similarly, AND gate 866 has as its inputs K7 T1, which occurs two time frames after the K6 T7 latch time. This has the effect of delaying the latch command by two time frames thereby causing the data stream to move two time frames further along in the keyers. This produces a transposition of two half steps higher in frequency. Rather than utilizing a separate AND gate for producing the enabling pulse at the time K0 T0, a different technique has been utilized. This is because of timing and synchronization difficulties sometimes experienced when making the transition between both a new T number and a new K number. The output of AND gate 867 is delayed one bit by flip-flop 874, which is clocked by the multiplex clock train on line 875. The output 876 of flip-flop 874, then, carries a pulse which synchronous with the K7 T0 time.

The outputs of AND gates 863, 864, 865, 866, 867, 868, 869, 870, 871, 872 and line 876 form the inputs of AND gates 877, 878, 879, 880, 881, 882, 883, 884, 885 and 886. Only one of these AND gates is enabled, however, by selector switch 861, so that only one of the outputs from AND gates 863–872 or line 876 will be connected to the collecting OR gate 887.

It will be noted that AND gates 884 and 885 are collected by OR gate 888 and then connected to OR gate 887 over line 889.

Momentary contact switch 890 clocks divide-by-two flip-flip 891 which has its Q output connected to line 892 and its Q output connected to one of the inputs of AND gate 893 over line 894. The inversion of the output is inverted by inverter 895 and connected to one of the inputs of AND gate 896. When momentary switch 890 is pressed once, flip-flop 891 disables AND gate 893 so that the normal latch pulse on 862 is blocked. At the same time, the inverted output to AND gate 896 enables the output 898 from OR gate 887 to pass to collecting OR gate 899. The output 900 of OR gate 899 is connected to the latch input line (FIG. 2) of each of the keyers 86, 98, 104, 92 and 148 (FIG. 1). When switch 890 is pressed again, flip-flop 891 assumes its alternate state thereby disabling AND gate 896 to prevent the passage of the transposed latch pulse, and enables AND gate 893 to permit the normal K6 T7 pulse to be connected to the input of OR gate 899 over line 901. LED circuit 902 provides a visual indication when the transposition circuit is actuated.

Figure 19A:
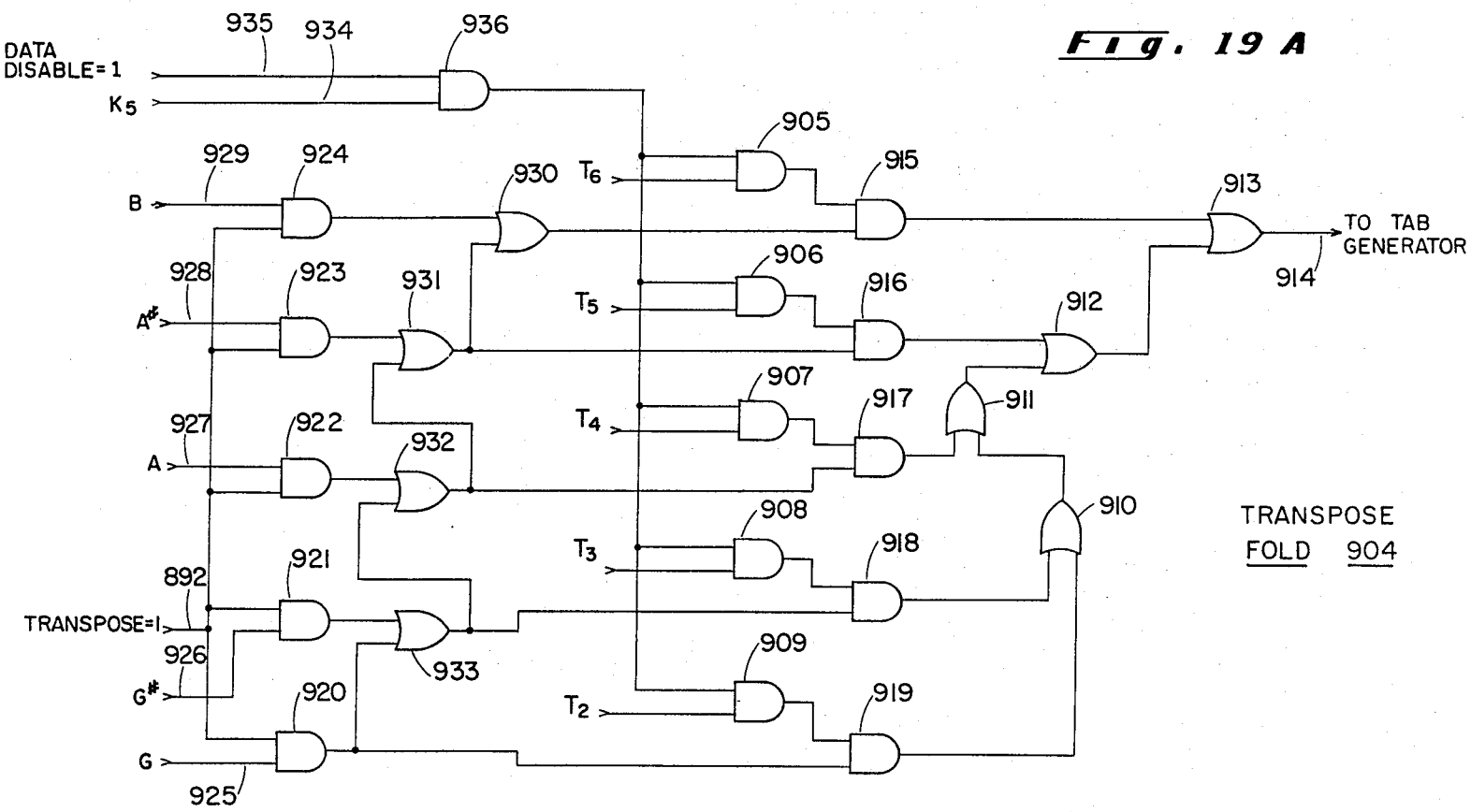
FIG. 19A is a schematic of the transpose fold circuit.

With reference now to FIG. 19A, the fold circuitry associated with transposer 856 will be described. Output lines 903 from transposer 856 (FIG. 19) will be activated when selector switch 861 is turned to any position indicating that the transposition will be in the flat direction. This means that switch 861 is in the B, A♯, A, G♯ or G positions. When transposing flat, if the sixteen foot tab is on, low C will be lost if the data is transposed one time frame flat, low C and C♯ will be lost if it is tranposed two time frames, low C, C♯ and B will be lost if it is transposed three time frames, etc. This is because the data will not have sufficient time to be advanced completely into the demultiplexer keyers 86, 98, 104, 92 and 148 before the transposed latch command occurs.

The data which would otherwise not fully enter the keyers before latch command is injected into the data stream one octave higher by the transposer fold circuit 904 in FIG. 19A. Thus, if the data stream is transposed one time frame flat and the low C key is depressed with the sixteen foot tab on, a pulse will be injected into the data stream in the C position in the next octave, which is the position of the transposed note exactly one octave higher. If the data stream is transposed two time frames flat, this pulse would still be injected in the data stream in the C position in the next octave. If both the low C and C♯ keys in the lowest octave are depressed, two pulses would be injected for the situation where the data stream is transposed two time frames flat, one pulse in the C position and one pulse in the C♯ position in the next highest octave.

This is accomplished by providing a series of five AND gates 905, 906, 907, 908 and 909, the inputs of which are the K5 line and the T6, T5, T4, T3 and T2 lines, respectively. AND gates 905–909 produce pulses on their outputs at the K-T times indicated, and their outputs are gated to collecting OR gates 910, 911, 912 and 913 to output line 914 depending on whether the respective AND gates 915, 916, 917, 918 and 919 are enabled. Line 914 is connected to each of the tab generator collector portions, an example of which is shown in FIG. 15, and causes AND gate 756 (FIG. 15) to produce an output on its output line 758 if the sixteen foot tab switch 718 is also closed. This enables AND gate 726 to pass those pulses in the eight foot data stream on line 711 which correspond to the enabling control pulses on line 728. The enabling control pulses are selected such that they occur twelve bits ahead of those time frames below low C, which are lost if the data stream is transposed flat. For example, if the data stream is transposed flat by one time frame, which is achieved by turning selector switch 861 to the B position, and low C is depressed with the sixteen foot tab actuated, this tone would not be played. To enable the tone to be heard, AND gate 726 is enabled so that the data stream on the eight foot line, which is the normal data stream, will be gated to the output of AND gate 726 only during that time frame in which AND gate 726 is enabled. By selecting the proper K and T driver lines, AND gate 726 will be enabled in exact coincidence with the played note on the eight foot line 711. Since line 711 carries the entire data stream regardless of whether the eight foot tab switch 720 is depressed, the single pulse passed by enabled AND gate 726 will be played in the eight foot range. It should be noted that similar injection circuitry is utilized in the other tab generators 76, 120, 128 and 168 as well.

If the data stream is transposed two time slots lower, then both AND gates 905 and 906 will produce output pulses at the K5 T6 and K5 T5 times which correspond to the time frames associated with the lost keys played one octave higher. In this case, this would correspond to the C and C# keys in the lowest octave of the manual. Again, AND gate 726 would be enabled during these two time frames to pass the serial data stream on line 711, which, if it contained keydown pulses in these two time frames, would produce the C and C# notes in the eight foot range.

The K5 line 934 is gated together with the data disable line 935 by AND gate 936 so that it is effective only during the alternate scans of the manuals. Transpose line 892 from FIG. 19 enables AND gates 920, 921, 922, 923 and 924, the other inputs of which are connected to the transpose fold control lines 925, 926, 927, 928 and 929, respectively, which are indicated generally as 903 in FIG. 19. A control signal on line 929, which is connected thereto by positioning selector switch 861, indicates transposition flat by one time frame. Similar control signals on lines 928, 927, 926 and 925 indicate transposition flat by two time frames, three time frames, four time frames, and five time frames, respectively.

The outputs of AND gates 920–924 are collected together by OR gates 930, 931, 932 and 933 in a priority fashion so that if a control signal is present on any of lines 925–929, the series connected OR gates 933–930 will enable all of the AND gates 915–919 corresponding to a lower degree of transposition. For example, if AND gate 923 is enabled, OR gate 931 will produce an enabling signal on AND gate 916 and also transmit an enabling signal through OR gate 930 to AND gate 915. An output from OR gate 932 will enable AND gate 917, and also enable AND gates 915 and 916 through OR gates 930 and 931, respectively. Thus, if selector switch 861 is moved to the G position, thereby causing transposition of five time frames flat, each of AND gates 915–919 will be enabled and five time slots will be passed through AND gate 756 in FIG. 15 from the eight foot data line 711.

The choice of T and K lines is completely dependent on the multiplexing sequence that is employed. In this sense, the selection of the K and T lines for transposition, latching, transpose fold, and the like depends on their particular relationship to the data stream. The time frames in the data stream could be numbered sequentially or in pitch and octave format. All that is necessary is to determine at which point in the data stream the particular control pulse or pulses are to be generated to produce the desired effect.

Figure 20:
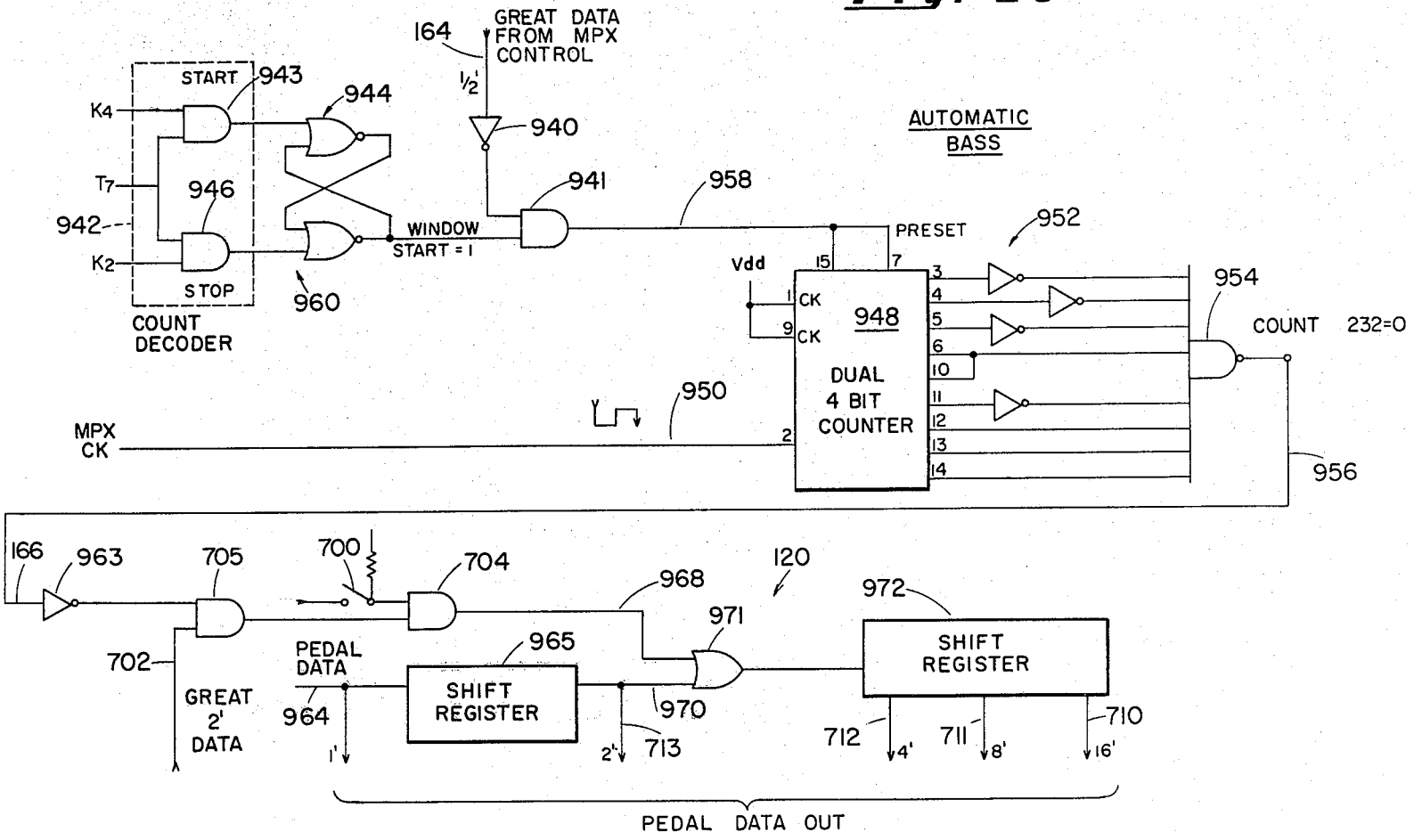
FIG. 20 is a schematic of the automatic bass circuit.

The automatic bass circuit 160 is illustrated in FIG. 20 together with portions of the great tab generator 128 and pedal tab generator 120. As discussed earlier, one of the features of the present invention is that of an automatic bass wherein the pedalboard 24 is deactivated and the lowest note played in the lowest two octaves of the great manual 22 is coupled to the pedal tab generator for voicing as if it were being played on the pedalboard itself. This feature enables a person able to play another keyboard instrument, such as a piano, to play an organ without the necessity of learning to manipulate the pedalboard.

Great data from the multiplex control block 50 (FIG. 12) is brought into the automatic bass circuit on line 164, and this data is in the one-half foot range. It passes through inverter 940 to one of the inputs of AND gate 941. Count decoder 942 decodes the TK counts to open a window at K4 T7 by producing an output from activated AND gate 943 to set RS flip-flop 944. On count K2 T7, which is exactly twenty-four bits or two octaves later, the output of AND gate 946 goes high thereby resetting flip-flop 944. When flip-flop 944 is set, AND gate 941 is enabled to pass great data from inverter 940, and when flip-flop 944 is reset, AND gate 941 is disabled and will block great data from inverter 940.

A 4520 dual four bit counter 948 is clocked at the multiplex clock rate by the pulse train on multiplex clock line 950. This counter counts down from count 256, and its outputs are decoded by inverters 952 and NAND gate 954 such that it generates a pulse on output line 956 exactly at count 232. Counter 948 is reset, however, by the output 958 of AND gate 941, which carries the Great serial data stream within the lowest two octaves of great manual 22 as determined by window circuit 960. Each time that a data pulse appears on line 958, counter 948 will be reset and begin counting down from count 256.

This means that counter 948 always generates a pulse on line 956 exactly twenty-four counts, or two octaves of multiplex clock pulses, after it is preset to its starting count of 256. Thus, if three keys in the lowest two octaves of the Great manual are held depressed, when the highest depressed key is scanned, counter 948 will be reset to count 256. When the next count is detected, counter 948 will again be reset to count 256. Because the lowest two octaves are only twenty-four bits wide, the first and second scanned keys must be less than twenty-four keys apart so that counter 948 will again be reset. When the third key is scanned, which key is the lowest depressed key in the lower two octaves of Great manual 22, counter 948 will again be reset, and will produce an output pulse on line 956 exactly twenty-four bits later. Since the last-mentioned key is the lowest key depressed on the manual, no other keydown pulses will be present on line 164, which would reset counter 948. When the last key in the Great manual 22 is scanned, window circuit 960 will close thereby disabling AND gate 941 and preventing the further passage of data from line 164.

The pulse on line 956 connected to the output of AND gate 954 is exactly two octaves lower than the last keydown pulse which reset counter 948, and is therefore exactly two octaves lower than the lowest depressed key on the Great manual. It will be recalled that the incoming data on line 164 is in the one-half foot range, so that delaying this data by two octaves will place it in the two foot range, which is the desired footage for injection into the pedal data stream.

The lower portion of FIG. 22 illustrates a portion of the Great tab generator 128 (FIG. 14). The enabling pulse on line 956 is connected to the input 166 of converter 963, the output of which enables AND gate 705. The Great two foot data on line 702 is therefore passed by AND gate 705 to the input of AND gate 704, the latter being enabled by closing the automatic bass switch 700.

Pedal data on line 964 of pedal tab generator 120 is in the one foot range, and this is delayed by twelve bits by shift register 965 to produce the two foot output on line 713. The two foot automatic bass output on line 968 from AND gate 704 is added to the two foot pedal data on line 970 at the inputs of OR gate 971, and this is delayed by shift register 972 to produce the four foot, eight foot and sixteen foot outputs on lines 712, 711 and 710, respectively. This data is then collected and connected to the inputs of flute keyers 98 and the principal keyers 104 wherein it is demultiplexed.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In an electronic organ comprising a plurality of manuals each having a plurality of playing keys, multiplexer means for scanning said manuals simultaneously to produce a plurality of synchronized respective serial data streams each comprising a plurality of time slots corresponding on a one-to-one basis to the keys of the respective manual and having keydown signals in the time slots of depressed keys of the respective manual, demultiplex means having a plurality of stages corresponding respectively to the tones capable of being played by the organ and having data input means to which the data streams are connected and a latch control input means, said demultiplex means shifting said data streams through its stages and converting the serial data streams into parallel format under the control of the latch control signal on the latch control input means to cause the keydown signals to latch in the stages in which they are present at the time of serial to parallel conversion to thereby key tones corresponding to stages in which the keydown signals are latched, and means associated with said multiplex means for generating in succession a plurality of multiple bit digital timing signals synchronized with and corresponding respectively to the time slots of the synchronized data streams, the improvement being a transposer comprising: decoder means for decoding any one of a plurality of the digital timing signals occurring near the end of the scan of the manuals and producing the latch control signal on said demultiplex means control input in synchronism with the occurrence of said any one timing signal to cause said demultiplex means to convert the data streams into parallel format at that time, and player operated selector means for selecting any one timing signal from among the plurality of such signals occurring near the end of the scan of the manuals to change selectively the time of serial to parallel conversion to thereby transpose the keydown pulses to different stages of the demultiplex means at the time of serial to parallel conversion.

2. The electronic organ of claim 1 wherein said timing signals are driver signals generated by said multiplex means to multiplex said manuals.

3. The electronic organ of claim 2 wherein groups of the keys of each manual are connected to respective buses, each of said driver signals comprises a first part which actuates a particular bus on a manual and a second part which actuates a plurality of keys connected, respectively, to a plurality of the buses.

4. The electronic organ of claim 1 wherein said decoder means includes means for decoding all of said plurality of timing signals occurring near the end of the scan and producing control signals on a plurality of decoder outputs, and said selector means selects one of the control signals on the decoder outputs for transmission to the demultiplex means latch control input means.

5. The electronic organ of claim 4 wherein said decoder means and said selector means together comprise a plurality of gate circuits and a selector switch for enabling one of said gate circuits to transmit a latch control signal to the demultiplex means latch control input means.

6. The electronic organ of claim 1 wherein said manuals are each scanned from one end thereof to the other, including a fold circuit to prevent the transposition of the keydown signals outside the existing stages of said demultiplex means comprising means for detecting when a keydown signal is transposed outside the stages of the demultiplex means and would therefore not be capable of keying a tone, and injecting a keydown signal in a time slot in the respective serial data stream octavely related to the original time slot thereof and located such that the injected keydown signal is transposed to an existing stage of the demultiplex means.

7. The electronic organ of claim 6 wherein the injected keydown signal is injected into a time slot timewise ahead of the original time slot thereof.

8. The electronic organ of claim 6 wherein said fold circuit means comprises means for detecting when a plurality of keydown signals are transposed outside the existing stages of the demultiplex means and injecting a plurality of keydown signals in time slots in respective serial data stream octavely related to the original time slots thereof and located such that the injected keydown signals are transposed to existing stages of the demultiplex means.

9. The electronic organ of claim 6 wherein said fold circuit comprises means for monitoring said selector means to determine which of said timing signals is selected thereby and means for decoding a particular timing signal and enabling the injection of a keydown signal in the respective data stream in the time slot corresponding to the particular timing signal which is decoded.

10. The electronic organ of claim 9 wherein said particular timing signal which is decoded occurs ahead in time of the timing signal selected by said selector means.

11. In an electronic organ comprising a manual having a plurality of playing keys, multiplex means for scanning said manual to produce a serial data stream comprising a plurality of time slots corresponding on a one-to-one basis to the keys of the manual and having keydown signals in the time slots of depressed keys of the manual, demultiplex means having an input to which the data stream is connected, said demultiplex means demultiplexing the data stream on its input and keying tones corresponding to the keydown signals in the data stream, and a transposer for transposing the keydown signals including a player operated selector means for selecting a given amount of transposition and means for selectively modifying the timing relation between the serial data stream and the demultiplex means such that the keydown signals cause keying of the tones corresponding to keys differing from the depressed keys of the manual by the amount of transposition, the improvement being a fold circuit for ensuring that the keydown signals are not transposed outside the range of tones capable of being keyed by the organ comprising: means for monitoring the amount of transposition selected by said selector means and injecting a keydown signal into a time slot in the data stream spaced an octave away from the time slot of any keydown signal which would be transposed outside the range of tones capable of being keyed by the organ.

12. The electronic organ of claim 11 wherein the injected keydown signal is injected into the data stream timewise ahead of the time slot of the keydown signal which Uld be transposed outside the range of tones capable of being keyed by the organ.

13. The electronic organ of claim 11 wherein said demultiplex means comprises a plurality of stages corresponding respectively to the tones capable of being keyed by the organ, a latch input on which a latch control signal appears near the end of the scan of the manual, and means for shifting the data therefrom through said stages, the demultiplex means is responsive to said latch control signal to convert the serial data stream into parallel format to cause the keydown signals to latch in the stages in which they are present at the time of serial to parallel conversion, and said transposer advances and retards said latch control pulse to advance or retard, respectively, the serial to parallel conversion thereby transposing the keydown signals so that they are latched in different stages of the demultiplex means.

14. The electronic organ of claim 13 wherein said fold circuit detects when a keydown signal will be outside the existing stages of the demultiplex means at the time of serial to parallel conversion and injects the keydown signal in the data stream twelve time slots away so that it will be transposed to one of the existing stages of the demultiplex means.

15. The electronic organ of claim 14 wherein said fold circuit comprises means for injecting a plurality of keydown signals into respective time slots octavely spaced from the time slots of all keydown signals which would be transposed outside the existing stages of the demultiplex means.

* * * * *